US007788091B2

(12) United States Patent
Goudar et al.

(10) Patent No.: US 7,788,091 B2
(45) Date of Patent: Aug. 31, 2010

(54) METHODS, DEVICES AND SYSTEMS FOR IMPROVED PITCH ENHANCEMENT AND AUTOCORRELATION IN VOICE CODECS

(75) Inventors: Chanaveeragouda V. Goudar, Bangalore (IN); Murali M. Deshpande, Bangalore (IN); Pankaj Rabha, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 1315 days.

(21) Appl. No.: 11/231,686

(22) Filed: Sep. 21, 2005

(65) Prior Publication Data

US 2006/0074639 A1 Apr. 6, 2006

Related U.S. Application Data

(60) Provisional application No. 60/612,494, filed on Sep. 22, 2004, provisional application No. 60/612,497, filed on Sep. 22, 2004.

(51) Int. Cl.
*G10L 11/04* (2006.01)
*G10L 19/12* (2006.01)

(52) U.S. Cl. ..... 704/207; 704/223; 704/221

(58) Field of Classification Search ..... None
See application file for complete search history.

(56) References Cited

U.S. PATENT DOCUMENTS 6,470,309 B1 10/2002 McCree
6,493,665 B1 12/2002 Su et al.
6,766,289 B2 7/2004 Kandhadai et al.
6,789,059 B2 9/2004 Kandhadai et al.
2002/0007269 A1 1/2002 Gao
2002/0103638 A1 8/2002 Gao
2003/0078771 A1 4/2003 Jung et al.
2003/0097258 A1 5/2003 Thyssen
2004/0098254 A1 5/2004 Lee et al.
2004/0181400 A1* 9/2004 Kannan et al. ..... 704/223

OTHER PUBLICATIONS

3GPP2, "Selectable Mode Vocoder Service Option for Wideband Spread Spectrum Communication Systems," Dec. 2001, C.S0030-0, Version 2.0.*

3GPP2, "Selectable Mode Vocoder Service Option for Wideband Spread Spectrum Communication Systems," Dec. 2001, C.S0030-0, Version 2.0, pp. 3-4, 13-14, 61, 143-145, 159-178, Figs. 5.3-1 and 5.6-1,2.

Baron, "Five Chips From TI—or, Is It Six?" Microprocessor Report, Instat-MDR, Mar. 17, 2003, Figs. 1, 3, 4.

* cited by examiner

*Primary Examiner*—Angela A Armstrong
(74) *Attorney, Agent, or Firm*—Wade J. Brady, III; Frederick J. Telecky, Jr.

(57) ABSTRACT

An electronic circuit includes a storage circuit and a microprocessor operable together with the storage circuit as a speech coder. The speech coder has a backward pitch enhancement in frames or subframes having a length and at least one main pulse and at least one backward pitch enhancement pulse preceding the main pulse by a portion of the length called a pitch lag, and is operable to limit in number any such backward pitch enhancement pulse or pulses to a predetermined maximum number more than none upon an occurrence when the length divided by the pitch lag is at least one more than that maximum number. Other forms of the invention involve systems, circuits, devices, processes and methods of operation.

40 Claims, 9 Drawing Sheets

LAG=25

Φ
0
5
10
15
20
25
30
35
39
0
5
10
15
20
25
30
35
39

LAG=40

Φ
0
5
10
15
20
25
30
35
39
0
5
10
15
20
25
30
35
39

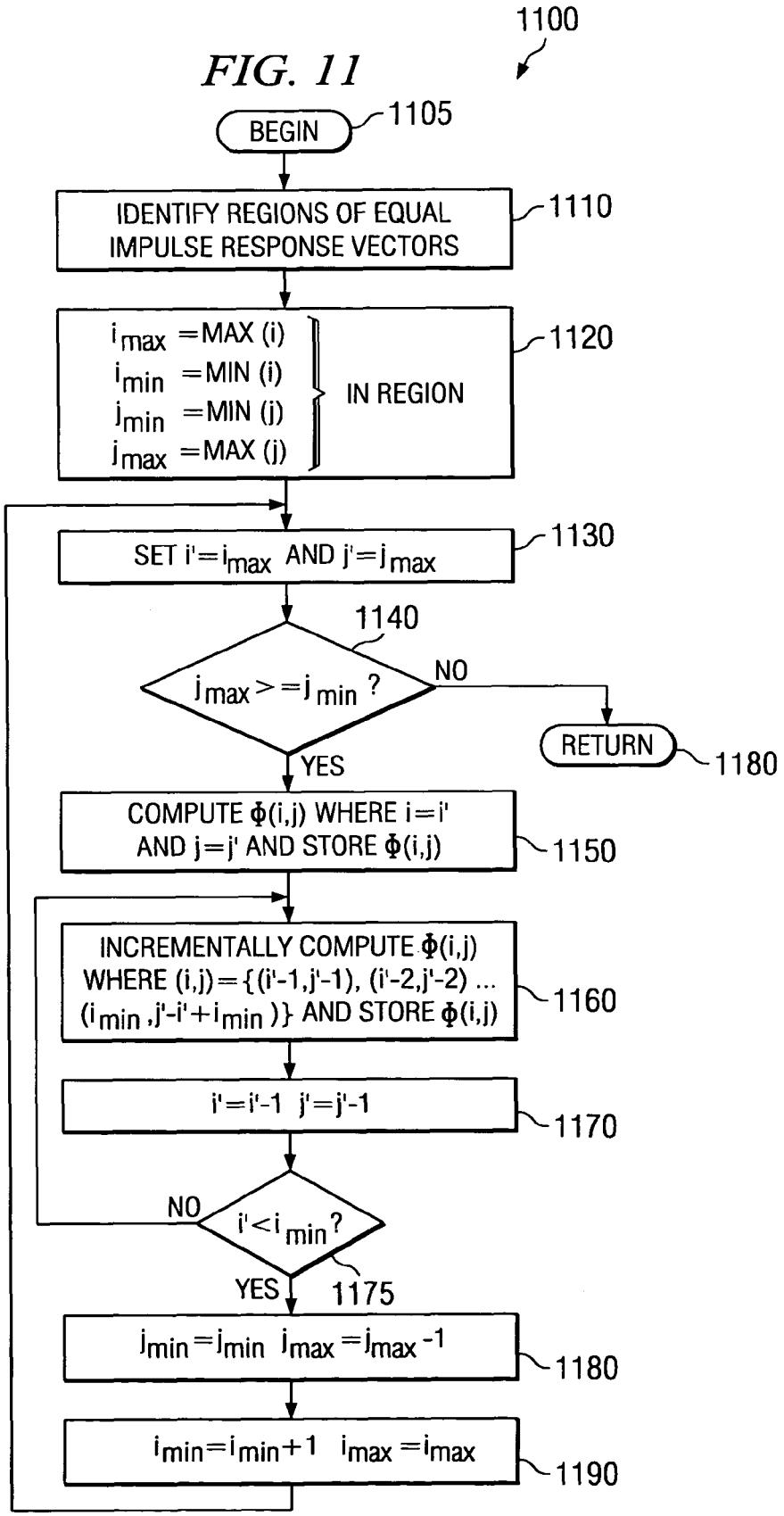
1100
FIG. 11
BEGIN
1105
IDENTIFY REGIONS OF EQUAL IMPULSE RESPONSE VECTORS
1110
$i_{max}$ =MAX (i)
$i_{min}$ =MIN (i)
$j_{min}$ =MIN (j)
$j_{max}$ =MAX (j)
IN REGION
1120
SET $i'=i_{max}$ AND $j'=j_{max}$
1130
1140
$j_{max}>=j_{min}$ ?
NO
RETURN
1180
YES
COMPUTE Φ(i,j) WHERE i=i' AND j=j' AND STORE Φ(i,j)
1150
INCREMENTALLY COMPUTE Φ(i,j) WHERE (i,j)={(i'-1,j'-1), (i'-2,j'-2) ... ($i_{min}$ ,j'-i'+$i_{min}$ )} AND STORE Φ(i,j)
1160
i'=i'-1 j'=j'-1
1170
NO
$i'<i_{min}$?
YES
1175
$j_{min}=j_{min}$ $j_{max}=j_{max}-1$
1180
$i_{min}=i_{min}+1$ $i_{max}=i_{max}$
1190

METHODS, DEVICES AND SYSTEMS FOR IMPROVED PITCH ENHANCEMENT AND AUTOCORRELATION IN VOICE CODECS

CROSS-REFERENCE TO RELATED APPLICATIONS

This application is related to provisional U.S. Patent Application Ser. No. 60/612,494, filed Sep. 22, 2004, titled "Methods, Devices and Systems for Improved Pitch Enhancement in Voice Codecs," for which priority under 35 U.S.C. 119(e)(1) is hereby claimed and which is hereby incorporated herein by reference.

This application is related to provisional U.S. Patent Application Ser. No. 60/612,497, filed Sep. 22, 2004, titled "Methods, Devices and Systems for Improved Codebook Search for Voice Codecs," for which priority under 35 U.S.C. 119(e)(1) is hereby claimed and which is hereby incorporated herein by reference.

This application is co-filed so that the present U.S. non-provisional patent application "Methods, Devices and Systems for Improved Codebook Search for Voice Codecs" Ser. No. 11/231,643 and the present U.S. non-provisional patent application "Methods, Devices and Systems for Improved Pitch Enhancement and Autocorrelation in Voice Codecs" Ser. No. 11/231,686 each have the same application filing date, and each of said patent applications hereby incorporates the other by reference.

STATEMENT REGARDING FEDERALLY SPONSORED RESEARCH OR DEVELOPMENT

Not applicable.

BACKGROUND OF THE INVENTION

This invention is in the field of information and communications, and is more specifically directed to improved processes, circuits, devices, and systems for information and communication processing, and processes of operating and making them. Without limitation, the background is further described in connection with wireless and wireline communications processing.

Wireless and wireline communications of many types have gained increasing popularity in recent years. The mobile wireless (or "cellular") telephone has become ubiquitous around the world. Mobile telephony has recently begun to communicate video and digital data, in addition to voice. Wireless devices, for communicating computer data over a wide area network, using mobile wireless telephone channels and techniques are also available. Wireline communications such as DSL and cable modems and wireline and wireless gateways to other networks are proliferating.

The market for portable devices such as cell phones and PDAs (personal digital assistants) is expanding with many more features and applications. More features and applications call for microprocessors to have high performance but with low power consumption. Thus, keeping the power consumption for the microprocessor and related cores and chips to a minimum, given a set of performance requirements, is very important. In both the wireless and wireline areas, high efficiency of performance and in operational processes is essential to make affordable products available to a wider public.

Voice over Packet (VoP) communications are further expanding the options and user convenience in telephonic communications. An example is Voice over Internet Protocol (VoIP) enabling phone calls over the Internet.

Wireless and wireline data communications using wireless local area networks (WLAN), such as IEEE 802.11 compliant, have become especially popular in a wide range of installations, ranging from home networks to commercial establishments. Other wireless networks such as IEEE 802.16 (WiMax) are emerging. Short-range wireless data communication according to the "Bluetooth" and other IEEE 802.15 technology permits computer peripherals to communicate with a personal computer or workstation within the same room.

Security is important in both wireline and wireless communications for improved security of retail and other business commercial transactions in electronic commerce and wherever personal and/or commercial privacy is desirable. Added features and security add further processing tasks to the communications system. These portend added software and hardware in systems where affordability and power dissipation are already important concerns.

In very general terms, a speech coder or voice coder is based on the idea that the vocal chords and vocal tract are analogous to a filter. The vocal chords and vocal tract generally make a variety of sounds. Some sounds are voiced and generally have a pitch level or levels at a given time. Other sounds are unvoiced and have a rushing or whispering or sudden consonantal sound to them. To facilitate the voice coding process, voice sounds are converted into an electrical waveform by a microphone and analog to digital converter. The electrical waveform is conceptually cut up into successive frames of a few milliseconds in duration called a target signal. The frames are individually approximated by the voice coder electronics.

In speech or voice coder electronics, pulses can be provided at different times to excite a filter. Each pulse has a very wide spectrum of frequencies which are comprised in the pulse. The filter selects some of the frequencies such as by passing only a band of frequencies, thus the term bandpass filter. Circuits and/or processes that provide various pulses, more or less filtered, excite the filter to supply as its output an approximation to the voice sounds of a target signal. Finding the appropriate pulses to use for the excitation pulses for the voice coder approximation purposes is involved in the subject of codebook search herein.

The filter(s) are characterized by a set of numbers called coefficients that, for example, may represent the impulse response over time when a filter is excited with a single pulse. Information identifying the appropriate pulses, and the values of the filter coefficients, and such other information as is desired, together compactly represent the speech in a given frame. The information is generated as bits of data by a processor chip that runs software or otherwise operates according to a speech coding procedure. Generally speaking, the output of a voice coder is this very compact representation which advantageously substitutes in communication for the vastly larger number of bits that would be needed to directly send over a communications network the voice signal converted into digital form at the output of the analog to digital converter were there no speech coding.

A speech or voice decoder is a coder in reverse in the sense that the decoder responds to the compact information sent over a network from a coder and produces a digital signal representing speech that can be converted by a digital-to-analog converter into an analog signal to produce actual sound in a loudspeaker or earphone.

Voice coders and decoders (codecs) run on RISC (Reduced Instruction Set Computing) processors and digital signal processing (DSP) chips and/or other integrated circuit devices that are vital to these systems and applications. Reducing the computer burden of voice codecs and increasing the efficiency of executing the software applications on these microprocessors generally are very important to achieve system performance and affordability goals and operate within power dissipation and battery life limits. These goals become even more important in hand held and mobile applications where small size is so important, to control the real-estate, memory space and the power consumed.

SUMMARY OF THE INVENTION

Generally, a form of the invention involves a process of backward pitch enhancement for a speech coding method of processing speech in frames or subframes having a length by supplying at least one main pulse and at least sometime associating with the main pulse at least one backward pitch enhancement pulse preceding the main pulse by a portion of the length called a pitch lag. The process involves limiting in number any such backward pitch enhancement pulse or pulses to a predetermined maximum number more than none upon an occurrence when the length divided by the pitch lag is at least one more than that maximum number.

Generally, another form of the invention involves a method of pitch enhancement including determining whether subframe size is in a predetermined range and when subframe size is in the predetermined range, limiting backward enhanced pulses to a maximum of two, and computing a pitch-enhanced filter impulse response based on the backward enhanced pulses.

Generally, still another form of the invention involves an electronic circuit including a storage circuit and a microprocessor operable together with the storage circuit as a speech coder. The speech coder has a backward pitch enhancement in frames or subframes having a length and at least one main pulse and at least one backward pitch enhancement pulse preceding the main pulse by a portion of the length called a pitch lag, and operable to limit in number any such backward pitch enhancement pulse or pulses to a predetermined maximum number more than none upon an occurrence when the length divided by the pitch lag is at least one more than that maximum number.

Generally, a further form of the invention involves a process of backward pitch enhancement for a speech coding method of processing speech in frames or subframes having a length by supplying at least one main pulse and at least sometime associating with the main pulse at least one backward pitch enhancement pulse preceding the main pulse by a portion of the length called a pitch lag. The process involves incrementally generating different values of autocorrelation of filter impulse response within a region of the autocorrelation where the number of backward pitch enhancement pulses is the same in the region; and supplying coded speech that depends on different values of autocorrelation incrementally generated.

Generally, another further form of the invention involves an electronic circuit including a storage circuit and a microprocessor operable together with the storage circuit as a speech coder. The speech coder has a backward pitch enhancement in frames or subframes having a length and at least one main pulse and at least one backward pitch enhancement pulse preceding the main pulse by a portion of the length called a pitch lag, and operable for incremental generation of different values of autocorrelation of filter impulse response within a region of the autocorrelation where the number of backward pitch enhancement pulses is the same in the region, and to supply coded speech that depends on different values of autocorrelation incrementally generated.

Other forms of the invention involve systems, circuits, devices, wireline and wireless communication devices, processes and methods of operation, as disclosed and claimed.

BRIEF DESCRIPTION OF THE DRAWINGS

FIG. 11 is a flow chart representing an inventive method for operating a processor to generate each of several regions of the Phi matrix data structure of FIGS. 9, 10A, 10B, 10C for use in the inventive method for Pitch Enhancement of FIG. 8.

Corresponding numerals ordinarily identify corresponding parts in the various Figures of the drawing except where the context indicates otherwise.

DETAILED DESCRIPTION

Figure 1:
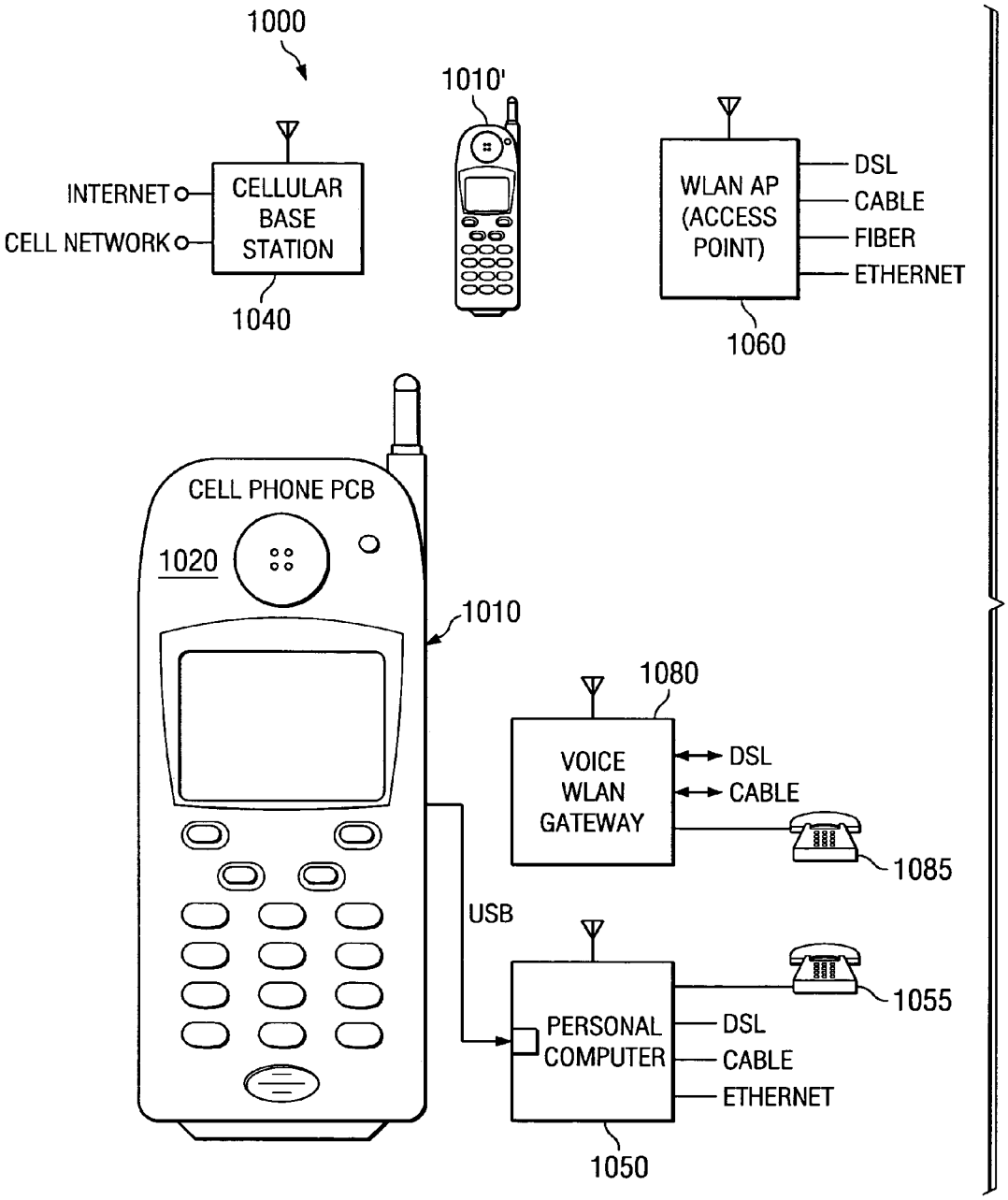
FIG. 1 is a pictorial diagram of a communications system including a cellular base station, two cellular telephone handsets, a WLAN AP (wireless local area network access point), a WLAN gateway with VoP phone, a personal computer (PC) with VoP phone, a WLAN station on the PC, and any one, some or all of the foregoing improved according to the invention.

In FIG. 1, an improved communications system 1000 has system blocks as described next. Any or all of the system blocks, such as cellular mobile telephone and data handsets 1010 and 1010', a cellular (telephony and data) base station 1040, a WLAN AP (wireless local area network access point, IEEE 802.11 or otherwise) 1060, a Voice WLAN gateway 1080 with user voice over packet telephone 1085, and a voice enabled personal computer (PC) 1050 with another user voice over packet telephone 1055, communicate with each other in communications system 1000. Each of the system blocks 1010, 1010', 1040, 1050, 1060, 1080 are provided with one or more PHY physical layer blocks and interfaces as selected by the skilled worker in various products, for DSL (digital subscriber line broadband over twisted pair copper infrastructure), cable (DOCSIS and other forms of coaxial cable broadband communications), premises power wiring, fiber (fiber optic cable to premises), and Ethernet wideband network. Cellular base station 1040 two-way communicates with the handsets 1010, 1010', with the Internet, with cellular communications networks and with PSTN (public switched telephone network).

In this way, advanced networking capability for services, software, and content, such as cellular telephony and data, audio, music, voice, video, e-mail, gaming, security, e-commerce, file transfer and other data services, internet, world wide web browsing, TCP/IP (transmission control protocol/Internet protocol), voice over packet and voice over Internet protocol (VoP/VoIP), and other services accommodates and provides security for secure utilization and entertainment appropriate to the just-listed and other particular applications.

The embodiments, applications and system blocks disclosed herein are suitably implemented in fixed, portable, mobile, automotive, seaborne, and airborne, communications, control, set top box, and other apparatus. The personal computer (PC) 1050 is suitably implemented in any form factor such as desktop, laptop, palmtop, organizer, mobile phone handset, PDA personal digital assistant, internet appliance, wearable computer, personal area network, or other type.

Figure 2:
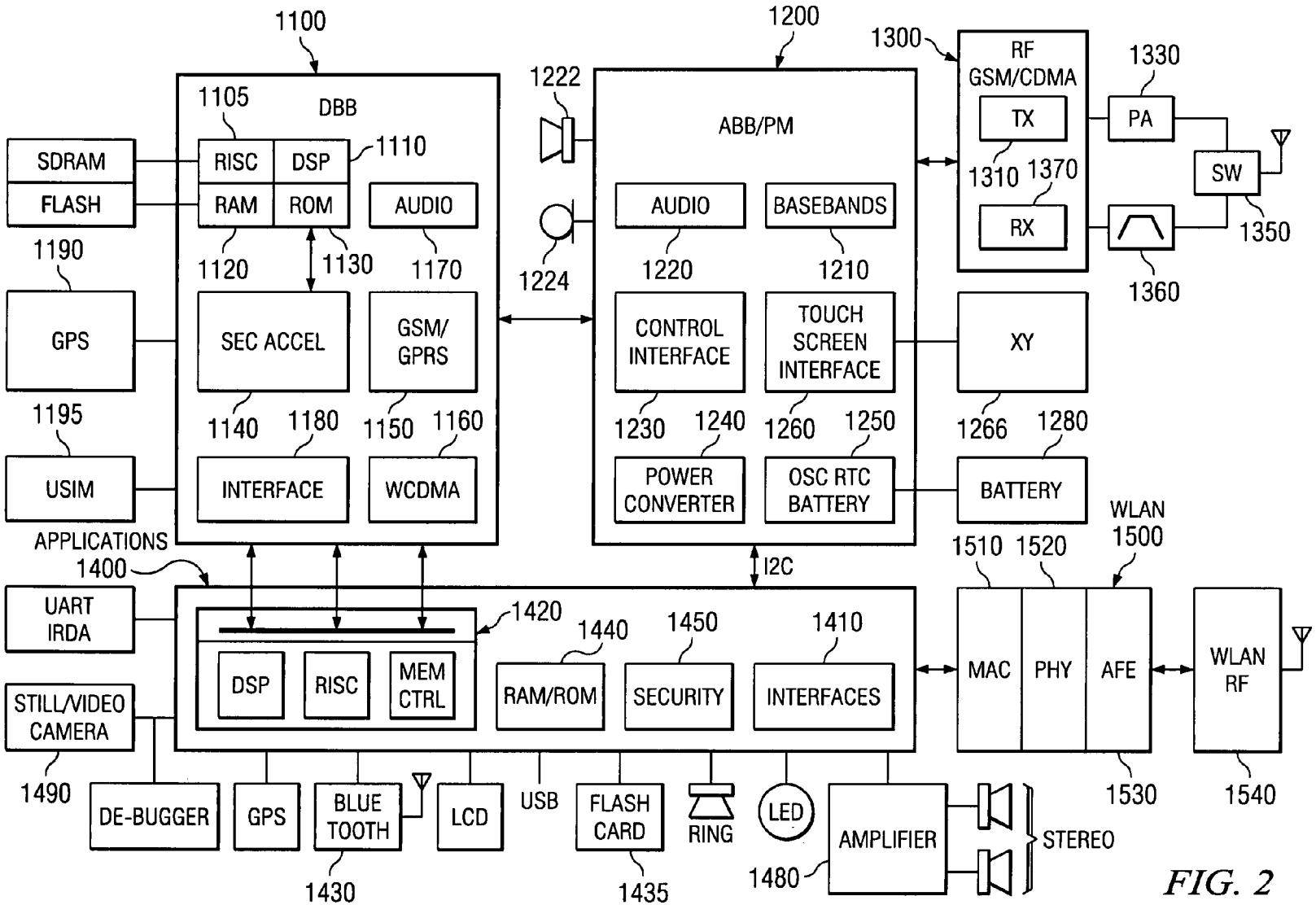
FIG. 2 is a block diagram of an inventive integrated circuit chip device with any subset or all of the chip circuits for use in the blocks of the communications system of FIG. 1 and improved according to the invention.

For example, handset 1010 is improved and remains interoperable and able to communicate with all other similarly improved and unimproved system blocks of communications system 1000. On a cell phone printed circuit board (PCB) 1020 in handset 1010, FIGS. 1 and 2 show a processor integrated circuit and a serial interface such as a USB interface connected by a USB line to the personal computer 1050. Reception of software, intercommunication and updating of information are provided between the personal computer 1050 (or other originating sources external to the handset 1010) and the handset 1010. Such intercommunication and updating also occur automatically and/or on request via WLAN, Bluetooth, or other wireless circuitry.

FIG. 2 illustrates inventive integrated circuit chips including chips 1100, 1200, 1300, 1400, 1500 for use in the blocks of the communications system 1000 of FIG. 1. The skilled worker uses and adapts the integrated circuits to the particular parts of the communications system 1000 as appropriate to the functions intended. For conciseness of description, the integrated circuits are described with particular reference to use of all of them in the cellular telephone handsets 1010 and 1010' by way of example.

It is contemplated that the skilled worker uses each of the integrated circuits shown in FIG. 2, or such selection from the complement of blocks therein provided into appropriate other integrated circuit chips, or provided into one single integrated circuit chip, in a manner optimally combined or partitioned between the chips, to the extent needed by any of the applications supported by the cellular telephone base station 1040, personal computer(s) 1050 equipped with WLAN, WLAN access point 1060 and Voice WLAN gateway 1080, as well as cellular telephones, radios and televisions, fixed and portable entertainment units, routers, pagers, personal digital assistants (PDA), organizers, scanners, faxes, copiers, household appliances, office appliances, combinations thereof, and other application products now known or hereafter devised in which there is desired increased, partitioned or selectively determinable advantages next described.

In FIG. 2, an integrated circuit 1100 includes a digital baseband (DBB) block 1110 that has a RISC processor (such as MIPS core, ARM processor, or other suitable processor) and a digital signal processor (or DSP core) 1110, communications software and security software for any such processor or core, security accelerators 1140, and a memory controller. The memory controller interfaces the RISC core and the DSP core to Flash memory and SDRAM (synchronous dynamic random access memory). The memories are improved by any one or more of the processes herein. On chip RAM 1120 and on-chip ROM 1130 also are accessible to the processors 1110 for providing sequences of software instructions and data thereto.

Digital circuitry 1150 on integrated circuit 1100 supports and provides wireless interfaces for any one or more of GSM, GPRS, EDGE, UMTS, and OF DMA/MIMO (Global System for Mobile communications, General Packet Radio Service, Enhanced Data Rates for Global Evolution, Universal Mobile Telecommunications System, Orthogonal Frequency Division Multiple Access and Multiple Input Multiple Output Antennas) wireless, with or without high speed digital data service, via an analog baseband chip 1200 and GSM transmit/receive chip 1300. Digital circuitry 1150 includes ciphering processor CRYPT for GSM ciphering and/or other encryption/decryption purposes. Blocks TPU (Time Processing Unit real-time sequencer), TSP (Time Serial Port), GEA (GPRS Encryption Algorithm block for ciphering at LLC logical link layer), RIF (Radio Interface), and SPI (Serial Port Interface) are included in digital circuitry 1150.

Digital circuitry 1160 provides codec for CDMA (Code Division Multiple Access), CDMA2000, and/or WCDMA (wideband CDMA or UMTS) wireless with or without an HSDPA/HSUPA (High Speed Downlink Packet Access, High Speed Uplink Packet Access) (or 1xEV-DV, 1xEV-DO or 3xEV-DV) data feature via the analog baseband chip 1200 and an RF GSM/CDMA chip 1300. Digital circuitry 1160 includes blocks MRC (maximal ratio combiner for multipath symbol combining), ENC (encryption/decryption), RX (downlink receive channel decoding, de-interleaving, viterbi decoding and turbo decoding) and TX (uplink transmit convolutional encoding, turbo encoding, interleaving and channelizing.). Block ENC has blocks for uplink and downlink supporting confidentiality processes of WCDMA.

Audio/voice block 1170 supports audio and voice functions and interfacing. Speech/voice codec(s) are suitably provided in memory space in audio/voice block 1170 for processing by processor(s) 1110. Applications interface block 1180 couples the digital baseband chip 1100 to an applications processor 1400. Also, a serial interface in block 1180 interfaces from parallel digital busses on chip 1100 to USB (Universal Serial Bus) of PC (personal computer) 1050. The serial interface includes UARTs (universal asynchronous receiver/transmitter circuit) for performing the conversion of data between parallel and serial lines. Chip 1100 is coupled to location-determining circuitry 1190 for GPS (Global Positioning System). Chip 1100 is also coupled to a USIM (UMTS Subscriber Identity Module) 1195 or other SIM for user insertion of an identifying plastic card, or other storage element, or for sensing biometric information to identify the user and activate features.

In FIG. 2, a mixed-signal integrated circuit 1200 includes an analog baseband (ABB) block 1210 for GSM/GPRS/EDGE/UMTS/HSDPA which includes SPI (Serial Port Interface), digital-to-analog/analog-to-digital conversion DAC/ADC block, and RF (radio frequency) Control pertaining to GSM/GPRS/EDGE/UMTS and coupled to RF (GSM etc.) chip 1300. Block 1210 suitably provides an analogous ABB for CDMA wireless and any associated 1xEV-DV, 1xEV-DO or 3xEV-DV data and/or voice with its respective SPI (Serial Port Interface), digital-to-analog conversion DAC/ADC block, and RF Control pertaining to CDMA and coupled to RF (CDMA) chip 1300.

An audio block 1220 has audio I/O (input/output) circuits to a speaker 1222, a microphone 1224, and headphones (not shown). Audio block 1220 has an analog-to-digital converter (ADC) coupled to the voice codec and a stereo DAC (digital to analog converter) for a signal path to the baseband block 1210 including audio/voice block 1170, and with suitable encryption/decryption activated or not.

A control interface 1230 has a primary host interface (I/F) and a secondary host interface to DBB-related integrated circuit 1100 of FIG. 2 for the respective GSM and CDMA paths. The integrated circuit 1200 is also interfaced to an I2C port of applications processor chip 1400 of FIG. 2. Control interface 1230 is also coupled via access arbitration circuitry to the interfaces in circuits 1250 and the baseband 1210.

A power conversion block 1240 includes buck voltage conversion circuitry for DC-to-DC conversion, and low-dropout (LDO) voltage regulators for power management/sleep mode of respective parts of the chip regulated by the LDOs. Power conversion block 1240 provides information to and is responsive to a power control state machine shown between the power conversion block 1240 and circuits 1250.

Circuits 1250 provide oscillator circuitry for clocking chip 1200. The oscillators have frequencies determined by one or more crystals. Circuits 1250 include a RTC real time clock (time/date functions), general purpose I/O, a vibrator drive (supplement to cell phone ringing features), and a USB On-The-Go (OTG) transceiver. A touch screen interface 1260 is coupled to a touch screen XY 1266 off-chip.

Batteries such as a lithium-ion battery 1280 and backup battery provide power to the system and battery data to circuit 1250 on suitably provided separate lines from the battery pack. When needed, the battery 1280 also receives charging current from a Battery Charge Controller in analog circuit 1250 which includes MADC (Monitoring ADC and analog input multiplexer such as for on-chip charging voltage and current, and battery voltage lines, and off-chip battery voltage, current, temperature) under control of the power control state machine.

In FIG. 2 an RF integrated circuit 1300 includes a GSM/GPRS/EDGE/UMTS/CDMA RF transmitter block 1310 supported by oscillator circuitry with off-chip crystal (not shown). Transmitter block 1310 is fed by baseband block 1210 of chip 1200. Transmitter block 1310 drives a dual band RF power amplifier (PA) 1330. On-chip voltage regulators maintain appropriate voltage under conditions of varying power usage. Off-chip switchplexer 1350 couples wireless antenna and switch circuitry to both the transmit portion 1310, 1330 and the receive portion next described. Switchplexer 1350 is coupled via band-pass filters 1360 to receiving LNAs (low noise amplifiers) for 850/900 MHz, 1800 MHz, 1900 MHz and other frequency bands as appropriate. Depending on the band in use, the output of LNAs couples to GSM/GPRS/EDGE/UMTS/CDMA demodulator 1370 to produce the I/Q or other outputs thereof (in-phase, quadrature) to the GSM/GPRS/EDGE/UMTS/CDMA baseband block 1210.

Further in FIG. 2, an integrated circuit chip or core 1400 is provided for applications processing and more off-chip peripherals. Chip (or core) 1400 has interface circuit 1410 including a high-speed WLAN 802.11a/b/g interface coupled to a WLAN chip 1500. Further provided on chip 1400 is an applications processing section 1420 which includes a RISC processor (such as MIPS core, ARM processor, or other suitable processor), a digital signal processor (DSP), and a shared memory controller MEM CTRL with DMA (direct memory access), and a 2D (two-dimensional display) graphic accelerator. Speech/voice codec functionality is suitably processed in chip 1400, in chip 1100, or both chips 1400 and 1100.

The RISC processor and the DSP in section 1420 have access via an on-chip extended memory interface (EMIF/CF) to off-chip memory resources 1435 including as appropriate, mobile DDR (double data rate) DRAM, and flash memory of any of NAND Flash, NOR Flash, and Compact Flash. On chip 1400, the shared memory controller in circuitry 1420 interfaces the RISC processor and the DSP via an on-chip bus to on-chip memory 1440 with RAM and ROM. A 2D graphic accelerator is coupled to frame buffer internal SRAM (static random access memory) in block 1440. A security block 1450 includes secure hardware accelerators having security features and provided for accelerating encryption and decryption of any one or more types known in the art or hereafter devised.

On-chip peripherals and additional interfaces 1410 include UART data interface and MCSI (Multi-Channel Serial Interface) voice wireless interface for an off-chip IEEE 802.15 ("Bluetooth" and high and low rate piconet and personal network communications) wireless circuit 1430. Debug messaging and serial interfacing are also available through the UART. A JTAG emulation interface couples to an off-chip emulator Debugger for test and debug. Further in peripherals 1410 are an I2C interface to analog baseband ABB chip 1200, and an interface to applications interface 1180 of integrated circuit chip 1100 having digital baseband DBB.

Interface 1410 includes a MCSI voice interface, a UART interface for controls, and a multi-channel buffered serial port (McBSP) for data. Timers, interrupt controller, and RTC (real time clock) circuitry are provided in chip 1400. Further in peripherals 1410 are a MicroWire (u-wire 4 channel serial port) and multi-channel buffered serial port (McBSP) to off-chip Audio codec, a touch-screen controller, and audio amplifier 1480 to stereo speakers. External audio content and touch screen (in/out) and LCD (liquid crystal display) are suitably provided. Additionally, an on-chip USB OTG interface couples to off-chip Host and Client devices. These USB communications are suitably directed outside handset 1010 such as to PC 1050 (personal computer) and/or from PC 1050 to update the handset 1010.

An on-chip UART/IrDA (infrared data) interface in interfaces 1410 couples to off-chip GPS (global positioning system) and Fast IrDA infrared wireless communications device. An interface provides EMT9 and Camera interfacing to one or more off-chip still cameras or video cameras 1490, and/or to a CMOS sensor of radiant energy. Such cameras and other apparatus all have additional processing performed with greater speed and efficiency in the cameras and apparatus and in mobile devices coupled to them with improvements as described herein. Further in FIG. 2, an on-chip LCD controller and associated PWL (Pulse-Width Light) block in interfaces 1410 are coupled to a color LCD display and its LCD light controller off-chip.

Further, on-chip interfaces 1410 are respectively provided for off-chip keypad and GPIO (general purpose input/output). On-chip LPG (LED Pulse Generator) and PWT (Pulse-Width Tone) interfaces are respectively provided for off-chip LED and buzzer peripherals. On-chip MMC/SD multimedia and flash interfaces are provided for off-chip MMC Flash card, SD flash card and SDIO peripherals.

In FIG. 2, a WLAN integrated circuit 1500 includes MAC (media access controller) 1510, PHY (physical layer) 1520 and AFE (analog front end) 1530 for use in various WLAN and UMA (Unlicensed Mobile Access) modem applications. PHY 1520 includes blocks for BARKER coding, CCK, and OFDM. PHY 1520 receives PHY Clocks from a clock generation block supplied with suitable off-chip host clock, such as at 13, 16.8, 19.2, 26, or 38.4 MHz. These clocks are compatible with cell phone systems and the host application is suitably a cell phone or any other end-application. AFE 1530 is coupled by receive (Rx), transmit (Tx) and CONTROL lines to WLAN RF circuitry 1540. WLAN RF 1540 includes a 2.4 GHz (and/or 5 GHz) direct conversion transceiver, or otherwise, and power amplifer and has low noise amplifier LNA in the receive path. Bandpass filtering couples WLAN RF 1540 to a WLAN antenna. In MAC 1510, Security circuitry supports any one or more of various encryption/decryption processes such as WEP (Wired Equivalent Privacy), RC4, TKIP, CKIP, WPA, AES (advanced encryption standard), 802.11i and others. Further in WLAN 1500, a processor comprised of an embedded CPU (central processing unit) is connected to internal RAM and ROM and coupled to provide QoS (Quality of Service) IEEE 802.11e operations WME, WSM, and PCF (packet control function). A security block in WLAN 1500 has busing for data in, data out, and controls interconnected with the CPU. Interface hardware and internal RAM in WLAN 1500 couples the CPU with interface 1410 of applications processor integrated circuit 1400 thereby providing an additional wireless interface for the system of FIG. 2. Still other additional wireless interfaces such as for wideband wireless such as IEEE 802.16 "WiMAX" mesh networking and other standards are suitably provided and coupled to the applications processor integrated circuit 1400 and other processors in the system.

Further described next are improved voice codecs, structures and processes and improving the systems and devices of FIGS. 1 and 2 with them. In the subsequent Figures, Selectable Mode Vocoder (SMV standard of 3GPP2 organization) is used without limitation as an example platform for improvements. It is emphasized that the improvements are generally applicable in voice codec search procedures and all other search procedures to which the advantages of the improvements herein commend their use. ACELP-based FCB searches (Algebraic Code Excited Linear Prediction Fixed CodeBook search procedures) and other procedures with pitch enhancement and otherwise are suitably improved by the inventive structures and processes taught herein.

SMV is an ACELP based speech codec. The quality of the speech attained by SMV and its multimodal operation capability makes it quite suitable for wireless mobile communication. The multi-mode feature of SMV varies the Rate and trades off channel bandwidth and voice quality as the Rate is changed. Applications include wireline and wireless voice gateways and 3G third generation and higher generation cell phone wireless handsets as well as other products shown in FIG. 1. Minimum performance specifications are defined for SMV by subjective and objective comparison with respect to a floating point reference. SMV speech quality is believed to be better than EVRC (Enhanced Variable Rate Codec)(TIA IS-127) at the same average data rate (mode 0) and equivalent to EVRC at a lower data rate (mode 1). The complexity of SMV in MIPS (millions of instructions per second) is the highest among CDMA speech codecs.

SMV processing involves frame processing and rate-dependent excitation coding. The frame processing includes speech pre-processing, computation of spectral Envelope Parameters, signal modification, and rate selection. The SMV encoder frame processing which includes speech pre-processing, LPC analysis, signal modification and LSF quantization has complexity of about 50% or half the complexity of the SMV encoder. The rate-dependent excitation coding involves an adaptive codebook search, a fixed codebook search with complexity of about 40% that of the encoder in the worst case, and gain quantization. Overall, the SMV encoder rate-dependent excitation coding is about 50% or half of the complexity of the SMV encoder.

The computational complexity of the SMV speech codec is higher than other CDMA speech codecs. A significant portion of the computational complexity in the SMV speech codec can be attributed to a fixed codebook search that is done using multiple codebooks. Some embodiments of fixed codebook search procedure for improving SMV and other voice coding processes are based on a special approach called Selective Joint Search herein.

SMV encodes each 20 millisecond speech frame at one of four different bit rates: full-rate (1), half-rate (½), quarter-rate (¼) and one-eighth-rate (⅛). The bit rate chosen depends on the mode of operation and the type of speech signal.

Frames assigned to full-rate (Rate 1) are further classified as Voiced-Stationary (Type 1) and Voiced-Non-Stationary (Type 0). Each of these two classes is associated with one or more "fixed codebooks" (FCB). Each fixed codebook consists of a list of pulse positions or a set of pulse combinations. One important step in the process of encoding speech is choosing the best pulse position(s) or combination from a codebook. The best pulse combination in the one that results in the lowest value of an error function and the highest value for a Cost function (herein referring to a data structure or function having a value that goes up as the error function goes down) among the pulse combinations that are searched. The Cost function increases with the goodness of fit, or goodness of approximation of the coded speech to the real speech being coded. Thus, the Cost function is high when an error function, such as the difference between the coded speech and the real speech being coded, is small.

In the codebook search, the Cost function is maximized so that the error function is minimized. For example, suppose first and second tracks (lists of pulse positions in a codebook) contribute respective amounts X and Y to the Cost function and provide a combined contribution to the Cost function. Further suppose X exceeds or is greater than Y, (X>Y). Hence the second track contributes less to the Cost function, and the second track is probably underperforming and hence it is to be refined. The process refines the underperforming tracks because that is where refinement can contribute the greatest improvement or increase to the Cost function. Note that the term "track" is sometimes used herein slightly differently than may be the case in the SMV spec. Herein, "track" can refer to the list or set of pulse positions available to a respective pulse, even when another pulse may have an identical list or set of pulse positions available to it. In case a choice needs to be made about refinement as between pulses having an identical list, the pulse having a pulse position in a previous search that contributed less to the Cost function ranks higher or more in need of refinement than a second pulse having the identical list of pulse positions available to it.

In the voiced-stationary case (Type 1) of SMV Full Rate 1, a single codebook of eight (8) pulse tracks is used. In the case of eight tracks, after the refinement is over, the result is that the target $T_g$ is now approximated by all eight (8) pulse position in eight tracks, i.e., one pulse position from each of the eight tracks, namely the two (2) highest-contributing tracks plus six (6) underperforming tracks that got refined and put through filter H. The two highest tracks are included because they were the original best two performers out of the eight. Usually, not all the track candidates are underperformers. In this example, six (6) underperforming tracks are chosen as a trade-off between computational complexity versus best possible track choice pulse position quality. Embodiments suitably vary for different applications, and different implementations of the same application, in the numbers of tracks that are selected for refinement.

In the voiced-non-stationary case (Type 0) of SMV Full Rate 1, any one of three codebooks are used, and this choice is based on secondary excitation characteristics maximizing the Cost function.

In the description herein, the term "Cost function" is used to refer to a degree of approximation for improving and increasing voice coding quality. The term "Cost function" is not herein referring to financial or monetary expense nor to technological complexity, any of which can be reduced by the improvements herein even though the Cost function is increased.

Figure 3:
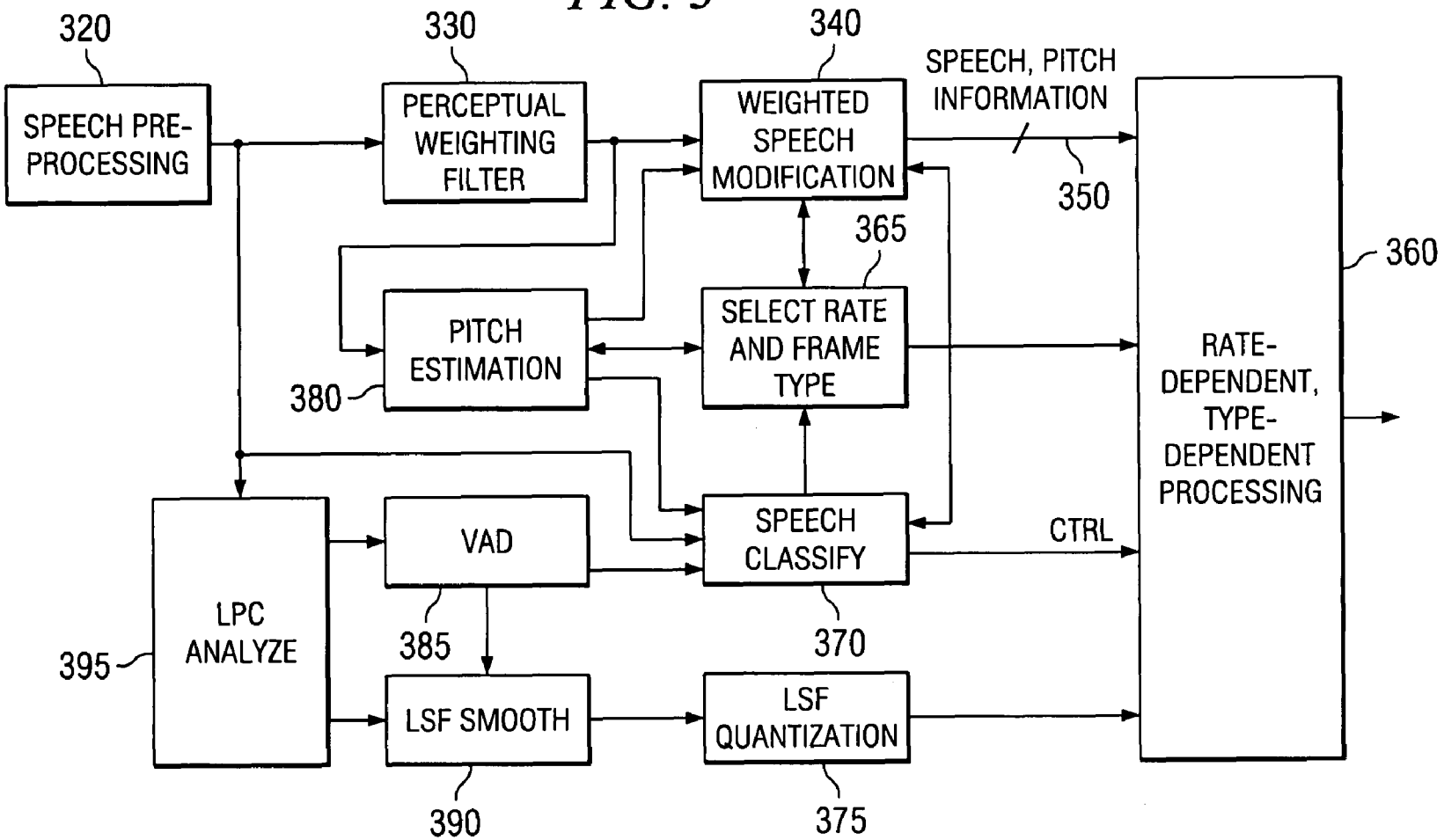
FIG. 3 is a process block diagram of SMV (Selectable Mode Vocoder) as example platform for inventive improvements to blocks as taught herein resulting in an inventive vocoder for the systems and devices of FIGS. 1 and 2.

FIG. 3 shows a method 310 for frame processing which provides the context for improvements over Selectable Mode Vocoder (SMV). Reference is made to "Selectable Mode Vocoder Service Option for Wideband Spread Spectrum Communication Systems," 3GPP2 C.S0030-0, Version 2.0, December, 2001 for background, which is hereby incorporated herein by reference.

A Speech Pre-processor 320 provides pre-processed speech as input to a Perceptual Weighting Filter 330 that produces weighted speech as input to Signal Modification block 340. Block 340 in turn supplies modified weighted speech to a line 350 to Rate and Type Dependent Processing 360. Further blocks 365, 370, 375 supply inputs to Rate and Type Dependent Processing 360. Block 365 provides Rate and Frame Type Selection. Also, blocks 365 and 370 each interact bi-directionally with Weighted Speech Modification block 340. Block 370 provides controls CTRL pertaining to speech classification. Block 375 supplies LSF (Line Spectral Frequency) Quantization information. Line Spectral Frequencies (LSFs) represent the digital filter coefficients in a pseudo-frequency domain for application in the Synthesis Filter 440.

A Pitch Estimation block 380 is fed by Perceptual Weighting Filter 330, and in turn supplies pitch estimation information to Weighted Speech Modification 340, to Select Rate and Frame Type block 365 and to Speech Classify block 370. Speech Classify block 370 is fed with pre-processed speech from Speech Pre-processing block 320, and with controls from a Voice Activity Detection (VAD) block 385. VAD 385 also feeds an output to an LSF Smoothing block 390. LSF Smoothing block 390 in turn is coupled to an input of LSF Quantization block 375. An LPC (Linear Predictive Coding) Analyze block 395 is responsive to Speech Pre-processing 320 to supply LPC analysis information to VAD 385 and to LSF Smoothing 390.

Figure 4:
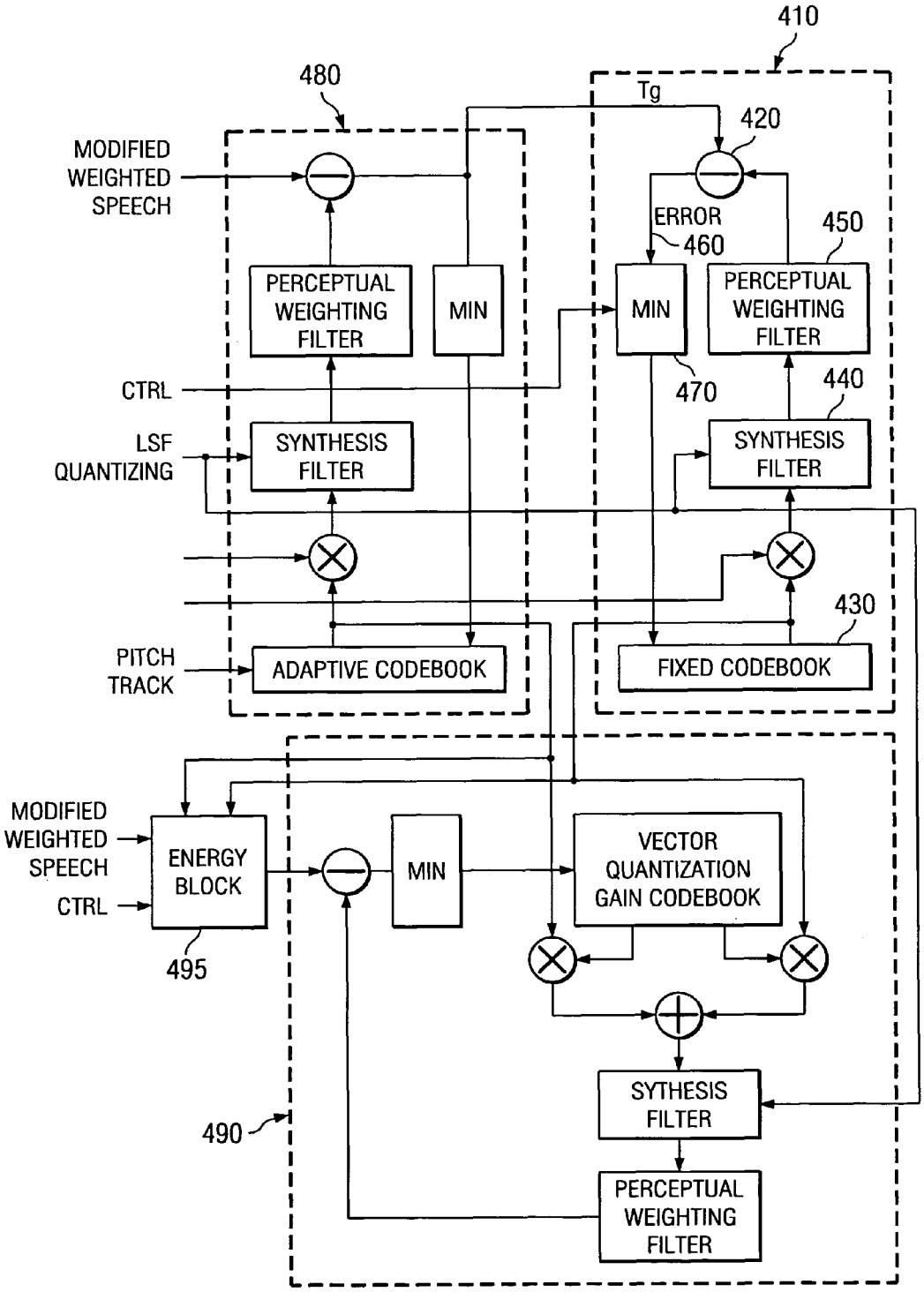
FIG. 4 is a more detailed process block diagram of a Rate and Type Dependent Processing block in FIG. 3, and having codebooks searched according to inventive improvements herein for exciting filter operation to approximate a target signal $T_g$.

FIG. 4 shows greater detail of Rate and Type Dependent Processing 360 of FIG. 3. FIG. 4, among other things, illustrates a method for excitation coding for Rate 1 (full-rate) and Rate ½ (Half Rate). Note in particular a Fixed-Codebook-based analysis-by-synthesis feedback circuit 410. This circuit 410 is related to the subject of the improvements discussed herein. Circuit 410 receives a "target signal" $T_g$ at a subtractor 420. Target signal $T_g$ represents the speech (remaining after adaptive codebook operations in a block 480 near block 410) to be optimally coded by block 410. The fixed codebook block 410 includes a Fixed Codebook operations block 430 followed by a synthesis filter 440. A perceptual weighting filter 450 couples synthesis filter 440 to subtractor 420. An error signal line 460 and Minimization block 470 couple subtractor 420 to fixed codebook block 430 to complete a feedback loop. Minimization block 470 is fed with control parameters CTRL from Speech Classify block 370 of FIG. 3. Synthesis Filter 440 is fed with LSF Quantization information from block 375. Fixed Codebook 430 has an output that is multiplied by optimal fixed codebook gain.

In FIG. 4, an Adaptive Codebook filter block 480 is organized similarly to Fixed Codebook filter block 410 and has a similar loop of Adaptive Codebook, multiplier, Synthesis Filter, Perceptual Weighting Filter, subtractor, and minimization looping back to Adaptive Codebook. Block 480 has a subtractor input for Modified Weighted Speech from block 340. Block 480 has a multiplier input for pitch gain multiplication of Adaptive Codebook output. LSF Quantization from block 375 is provided to the Synthesis Filter in block 480. Completion of the block 480 loop with a minimization block applies to voiced non-stationary (Type 0) frames. Minimization is omitted from the block 480 loop for processing voiced stationary (Type 1) frames.

Further in FIG. 4, an Energy block 495 is fed with Modified Weighted Speech from block 340 of FIG. 3, and with respective outputs from Adaptive Codebook ACB and Fixed Codebook FCB of FIG. 4.

A Vector Quantization Gain Codebook filter block 490 is organized somewhat similarly to Fixed Codebook filter block 410 and has a similar loop, except the Vector Quantization Gain Codebook feeds multipliers respectively fed by Adaptive Codebook and Fixed Codebook 430. In block 490 a Synthesis Filter receives a sum of the multiplier outputs, responds to LSF Quantization input, and is followed by Perceptual Weighting Filter, subtractor, and minimization looping back to Vector Quantization Gain Codebook. Block 490 has a subtractor input fed by the Energy block 495.

Figure 5:
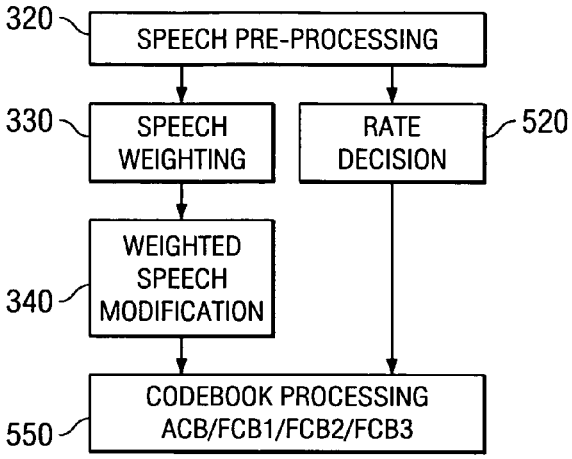
FIG. 5 is a process block diagram of SMV as example platform for inventive improvements to codebook searching as taught herein resulting in an inventive vocoder for the systems, devices and processes of FIGS. 1-4.

FIG. 5 summarizes an aspect of the process of finding the right pulses to excite a filter to approximate the target signal $T_g$. Pre-processed speech from block 320 is weighted by block 330 and is modified by block 340 and sent to codebook processing 550. A fixed codebook has predetermined information that designates time positions for each of a predetermined number of pulses that are allowed to excite the filter(s) for a given type of voice frame. Rate and Type decision signals from block 520 are coupled to the Codebook Processing block 550 in response to processed speech frames originated at block 320. Codebook Processing block 550 has adaptive codebook ACB and fixed codebook FCB. For instance, for analyzing Rate 1 frames, a fixed codebook is provided for analyzing Type 1 frames. Multiple sub-codebooks FCB1, FCB2, FCB3 are provided for analyzing Type 0 frames.

Each of multiple excitation pulses for use in speech excitation approximation is allocated a "track" in the codebook (or sub-codebook). The track for a respective pulse has a list of numbers that designates the set of alternative time positions, i.e., pulse positions that the codebook allows that pulse to occupy. "Codebook searching" involves finding the best number in a given track, and the best combination of pulses with which to define the set or subset of pulses which are identified and selected to excite the filter(s) of the analysis-by-synthesis feedback circuit 410. In this way, the process homes in on the approximation to a target signal $T_g$, for instance.

Various embodiments herein pertain to and improve fixed codebook search in fall-rate SMV and other codebook searching applications in voice codecs and otherwise. The existing and inventive methodologies are described below. Certain aspects of the search method are also described and illustrated in the co-filed and incorporated patent application TI-38348.

"Refinement" means search each of the pairs with joint search (except where the context specifically refers to single-pulse search) and, in the search process, pick the pulses which maximize the Cost function. "Search," "refine" and "refinement" are often used synonymously herein. Searching includes accessing codebook tracks and picking the pulses which maximize the Cost function, which thereby improves the approximation that is the goal of the procedure.

Rate 1 Voiced-Stationary (Type 1):

Standard SMV Methodology: The FCB for SMV Full Rate 1 consists of a combination of eight (8) pulses. The FCB search procedure consists of a sequence of repeated refinements referred to as "turns".

Each turn consists of several iterations. In each iteration for a given "turn," the process searches for a best pulse position of each pulse or a pair of pulses, while keeping all the other pulses at their previously determined positions.

The eight (8) pulse codebook is searched in two (2) turns using a standard "sequential joint search" procedure. A sequential joint search finds out best two (2) pulses position from the given set of candidate pulse positions specified by two adjacent "tracks" in the FCB. Here each track consists of candidate pulse positions. This is followed by two (2) turns of iterative single pulse search. This described search procedure is computationally very demanding. An efficient alternative to this search procedure is described below.

b) Method Embodiment: In an embodiment, single pulse search is done in the first turn unlike the two (2) turns of sequential joint search in the standard SMV methodology. This gives the initial estimation of the pulse positions. This is followed by a special process herein called Selective Joint Search unlike the two (2) turns of iterative single pulse search in the standard methodology. In the Selective Joint Search procedure the search is restricted to six tracks in the codebook. These six tracks correspond to the pulses that contribute least to a Cost function that is maximized when the error function is minimized. The error function is based on a mean squared error criterion.

Using this search method embodiment reduces the computational complexity of the fixed codebook search by around 50% without affecting the perceptual quality with respect to standard SMV decoded speech.

Rate 1 Voiced-Non-Stationary (Type 0):

Standard SMV Methodology: SMV Full Rate 1 uses three (3) sub-codebooks in this case. One of the three sub-codebooks that best models the present secondary excitation is chosen. "Secondary excitation" herein refers to excitation pulses which would be a best selection to drive the filter in block 410 to approximate the target signal $T_g$. "Secondary" refers to block 410 being coupled second electronically after block 480 in FIG. 4. In order to determine the best sub-codebook, a single pulse search procedure is adopted for all the three sub-codebooks.

The sub-codebook that minimizes the error criterion (maximizes the Cost function) is selected. The chosen sub-codebook is refined further using three turns of sequential joint search procedure.

Method Embodiment: In a further embodiment, one of the three sub-codebooks is chosen using a single pulse search. Further refinement of the selected best sub-codebook is done using Selective Joint Search instead of sequential joint search procedure. The same Selective Joint Search procedure as described in Voiced-Stationary (Type 1) case is used for selecting the tracks for further refinement. In the Selective Joint Search procedure the search is restricted to six tracks in the codebook. These six tracks correspond to the pulses that contribute least to a Cost function that is maximized when the error function is minimized. The error function is based on a mean squared error criterion.

Second Method Embodiment: Fast-select one sub-codebook, single-pulse search it, then Selective Joint Search is used to search that sub-codebook. The procedure of selecting one among three sub-codebooks is eliminated. This eliminates the complexity of searching additional two more sub-codebooks. The sub-codebook chosen is a priori decided, or dynamically predetermined prior to the single-pulse search, based on input parameters to the sub-codebook search.

The just-described Method Embodiments reduce the computational complexity of the fixed codebook search by 66% without affecting the perceptual quality with respect to standard SMV decoded speech.

Selective Joint Search is used to improve the voice coding by restricting the search procedure to a reduced number of tracks in the codebook. The tracks associated with the pulses that contribute least to a Cost function criterion are selected as they are more likely to be modified in further refinements.

Among other advantages, the method embodiment is computationally more efficient as it reduces the computational complexity up to 66% with respect to the standard fixed codebook search in SMV without affecting the perceptual quality of speech. The speech quality for the described method embodiment is perceptually the same with respect to standard SMV. Hence, this procedure can make the implementation of SMV computationally more efficient than the standard SMV.

A high density code upgrade embodiment reduces the computational complexity substantially. Greater channel density in channels per DSP core (9 vs. 7 for SMV) is provided by the embodiment at the same speech quality as SMV. Moreover, the embodiment provides higher speech quality at the same channel density as EVRC.

Reduced complexity fixed codebook search is based on Selective Joint Search as taught herein, compared to the higher complexity of fixed codebook search in SMV. In the SMV standard approach, high-complexity searches for best sub-codebook and best pulse positions are used. In an embodiment, a low complexity intelligent search best-guesses the pulse tracks for refinement. Also, the remarkable Selective Joint Search provides a simpler procedure to find the best pulse position.

Figure 6:
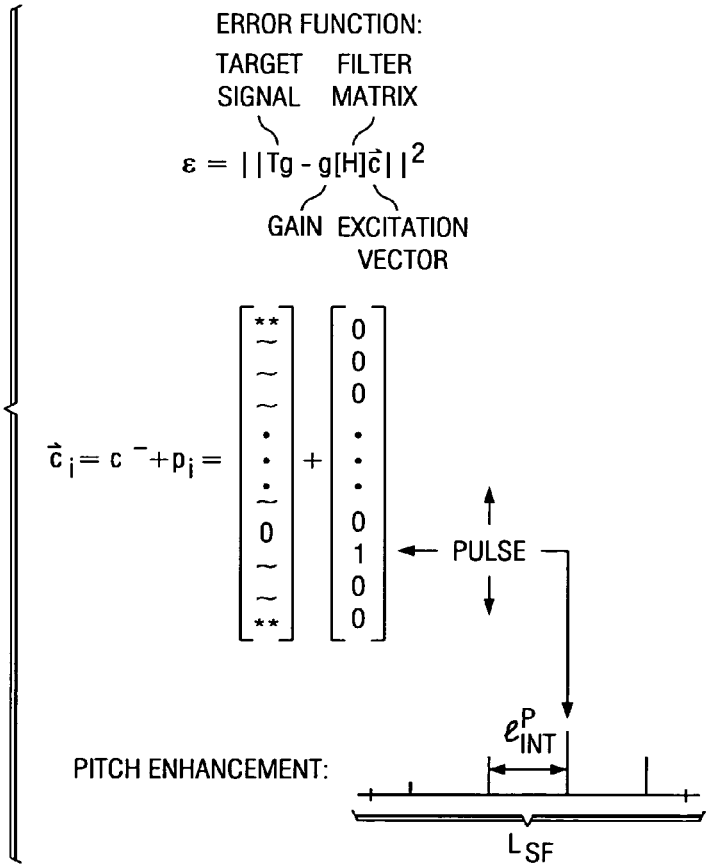
FIG. 6 is an illustration of a symbolic representation of data structures in which a target signal, filter, excitation, and pulses are used in the inventive improvements to the processes of FIGS. 3-6.

FIG. 6 shows an error function epsilon as a composite data structure or function of target signal $T_g$, gain g, filter matrix H, and excitation vector c. The error function is the mean square of the difference signal 460 (recall subtractor 420 of FIG. 4) produced as the subtraction difference between the target signal $T_g$ and the approximation of the codebook pulses-excited filter(s). (The error function somewhat resembles error variance, also known as mean square of residuals, as used in the terminology of regression analysis in statistics, but here a very rapidly occurring time series of data comprised in the frame is involved.) That approximation is represented by matrix multiplication product "g H c" in FIG. 6, where c is the excitation vector including the several the pulses $p_i$, H is an impulse response matrix representing the filter(s), and g is a gain or multiplier.

For purposes of FIG. 6, codebook search involves proper selection of the pulses $p_i$ that, summed together, compose the column vector c. (The impulse response filter matrix H is lower-triangular when backward pitch enhancements are folded into the code-vector. The impulse response matrix is not necessarily lower-triangular when backward pitch enhancements are folded into the impulse response matrix.) Here the approach is to break up vector c into a single pulse $p_i$ (lower right one "1" in column of zeroes) added to a vector of everything else ("c-") that may have so far resulted from codebook search to determine vector c. The "c-" vector correspondingly has a zero in the row entry where single pulse $p_i$ has a one (1). The rows of vector c correspond to pulse positions.

Much of this discussion is devoted to improving the process of searching to find how many "ones" (or pulses) should be entered into which rows (estimated pulse positions) of vector c.

To reduce the computational complexity, some embodiments perform the search using the Cost function epsilon tilde as a goodness of fit metric. Instead, of squaring many differences, the processor is operated to generate a bit-representation of a number and then square it to obtain a numerator, and then computes a bit-representation of a denominator number and then performs a division of the numerator by the denominator.

A goal in Fixed Codebook search is to minimize the epsilon (error function) in the equation (1)

$$\epsilon = \|T_G - gHc\|^2 \tag{1}$$

Alternatively this is equivalent to maximizing epsilon tilde as follows. Epsilon tilde is an example of what is called a "Cost function" herein.

$$\tilde{\varepsilon} = \frac{((T_g)^T Hc)^2}{\|Hc\|^2} = \frac{\left((H^T T_g)^T c\right)^2}{c^T H^T Hc} = \frac{((Tg^T H)c)^2}{(Hc)^T Hc} \tag{2}$$

Substituting symbols $b_{Tg}$ $(H^T T_g)^T$ and y=Hc, also yields the form:

$$\tilde{\varepsilon} = \frac{(b_{T_g} c)^2}{y^T y} = \frac{(b_{T_g} c)^2}{\|y^2\|} \tag{3A}$$

In some of the fixed codebook search embodiments herein, the Cost function epsilon tilde $\tilde{\epsilon}$ is maximized. Maximizing that Cost function is computationally simpler than and equivalent to minimizing the error function $\epsilon$ itself. In the description herein, the term "Cost function" is used to refer to a degree of approximation for improving and increasing voice coding quality. The term "Cost function" is not herein referring to financial or monetary expense nor to technological complexity, any of which can be reduced by the improvements herein even though the Cost function is increased.

Maximizing Cost function epsilon tilde is described next and elsewhere herein. Note that generating the denominator $\|y^2\|$ is an important part of the processing. The process of generating the denominator $\|y^2\|$ involves an autocorrelation matrix called Phi Matrix $\phi$.

$$\|y^2\| = \sum_{i=0}^{N-1} \Phi(p_i, p_i) + 2\sum_{i=0}^{N-2} \sum_{j=i+1}^{N-1} \Phi(p_i, p_j) \tag{3B}$$

In words, Equation (3B) represents a process of squaring many quantities identified in the output of Filter matrix H when excited with a sum of pulses at pulse positions $p_i$ selected from a codebook and making up code-vector c of FIG. 6. Note that Equation (3B) uses the symbol "$p_i$" to represents the numerical position of the singleton one (1) surrounded by zeroes in a corresponding pulse vector $p_i$ of FIG. 6. Since FIG. 6 illustrates a pulse vector, and Equation (3B) uses the scalar numerical position of the singleton one (1) in that pulse vector to index into the Phi Matrix, so that the use of the same symbol $p_i$ facilitates description of this process.

This squaring process in Equation (3B) produces a sum of many squared terms represented by the first summation (at left) over Phi on various values in its main diagonal. Added to the left sum, there follows on the right in Equation (3B) a double summation of many cross-product terms between the linear filter H impulse responses to the various pulses. In other words, the double summation sums up various off-diagonal values in the Phi Matrix. Since the autocorrelation compactly provides the various terms, the Phi Matrix is quite useful herein.

In Equation (3B), the letter N represents the number of pulse vectors in code-vector c of Equation 1.

The pulses can have either a positive (+) or negative (−) sign S. Such pulse signs are included in the pulse combination represented by vector c. Thus, vector c contains the sign information. The sign information is unnecessary to the computation of Phi Matrix. The sign information is included during computation of denominator $\|y^2\|$ which is described in Equation (3B). Since SMV also adds pitch enhancements, the symbols $S_i$ and $S_j$ used in SMV are suitably used as a multiplier inside the double-summation of Equation (3B). In such case, letter S represents the Sign value of plus one (+1) or minus one (−1) corresponding to the plus or minus value of a pre-computed product ($b_{Tg}$pi) of the target signal $T_g$ by filter matrix H by a particular pulse $p_i$.

In some embodiments as described herein, the process of generating the autocorrelation matrix Phi Matrix $\phi$ via Equation (3B) for use in obtaining the Cost function via Equation (3A), and using Phi Matrix anywhere else that Phi Matrix is suitably used, is greatly simplified and thereby processing is made swifter and more efficient. In this way, generating and maximizing the Cost function epsilon tilde is greatly facilitated. The advantages are even more critical when a voice coding feature called Pitch Enhancement is used, as described elsewhere herein. Still further improvements are also herein described for processes generating data structures when Pitch Enhancement is used.

The improvements taught herein have a domino effect of making processing swifter and more efficient for the voice coder as a whole. An ultimate result is that cell telephones and other wireless telecommunications devices using the embodiments operate with comparable voice quality, and save power consumption due to voice coding and voice codec operation, burden the processor less, increase channel density, and make processor time available for other applications.

Before describing Pitch Enhancement and generating the autocorrelation matrix Phi Matrix $\phi$, this description first describes, without limitation methods by which the Cost function epsilon tilde is maximized after it is generated. More detail on these methods is provided in the co-filed U.S. non-provisional patent application TI-38348 "Methods, Devices and Systems for Improved Codebook Search for Voice Codecs" Ser. No. 11/231,643, which is hereby incorporated herein by reference.

In fixed codebook FCB search, finding the best combination of pulse positions in tracks which maximize the Cost function $\tilde{\epsilon}$ is more important than, finding the combination of individual best pulses from each track T. In the Selective Joint Search approach herein, the contribution C(Tx) from a particular track Tx is defined, for one example and one type of method embodiment, as the difference in Cost function $\tilde{\epsilon}$ after eliminating the candidate pulse position from the initial state before Selective Joint Search. For example, let x,y,z,w be candidate pulse positions from different tracks Tx, Ty, Tz, Tw before the start of selective joint search. The overall Cost function is $\tilde{\epsilon}(x,y,z,w)$. The contribution C of position x to the Cost function is defined as $$Cx=\tilde{\epsilon}(x,y,z,w)-\tilde{\epsilon}(y,z,w). \quad (4X)$$

Similarly, $$Cy=\tilde{\epsilon}(x,y,z,w)-\tilde{\epsilon}(x,z,w), \quad (4Y)$$

$$Cz=\tilde{\epsilon}(x,y,z,w)-\tilde{\epsilon}(x,y,w) \text{ and} \quad (4Z)$$

$$Cw=\tilde{\epsilon}(x,y,z,w)-\tilde{\epsilon}(x,y,z). \quad (4W)$$

Now if Cx is highest among Cx, Cy, Cz, Cw, then eliminating candidate pulse position x will result in high error. In other words, the candidate pulse position x is already well fitted with other selected pulse positions to minimize the error, that is, deliver a highest possible value of the Cost function $\tilde{\epsilon}$. Hence, this track Tx containing candidate pulse position x need not be refined. If, for another instance, contribution Cz is least, then refining the track Tz containing pulse position z is expected to improve the Cost function $\tilde{\epsilon}$ in a manner which best combines or gels with other candidate pulse positions to give high Cost function measure $\tilde{\epsilon}(x,y,z',w)$ where z' is candidate pulse position refined from the track same as z. (Symbol prime (') on a pulse letter here represents refinement.)

Note that any selecting the "least contribution" can be accomplished using any data structure or function that either increases as the differences of Equations (4) increase or, alternatively, decreases as the differences of Equations (4) increase.

Still another example recognizes that the Cost function value $\tilde{\epsilon}(x,y,z,w)$ is the same in all the difference Equations (4). Accordingly, in this example, operations in the processor suitably select first for refinement the track T (or track pair as the case may be) that corresponds to the highest value of in a set of Cost function values $\{\tilde{\epsilon}(x,y,z), \tilde{\epsilon}(w,y,z), \tilde{\epsilon}(w,x,z), \tilde{\epsilon}(w,x,y)\}$ when the pulse having the pulse position from that track is omitted.

$$\text{Track Selection } Ts=\text{track with Max}(\{\tilde{\epsilon}(x,y,z), \tilde{\epsilon}(w,y,z), \tilde{\epsilon}(w,x,z), \tilde{\epsilon}(w,x,y)\} \quad (5)$$

The selection of Equation (5) is made because the track Ts, when omitted, is revealed to have been making the least contribution because the Cost function value with that track Ts omitted is the highest of any of the Cost function values even though that track Ts is omitted. Also, in some embodiments the refinement of tracks occurs in rigorous order of least contribution, and in other embodiments as simulation tests may suggest, another approximately-related order based on some selection of lower-contribution track(s) suitably guides the processor operations.

Accordingly, applying the important selection method of "least contribution" as taught herein comprehends a variety of alternative embodiments of operational methods which may involve selecting a highest or lowest value of a function with track omitted, or a highest or lowest value of a difference-related function between values with none, fewer and more subset(s) of track(s) omitted.

Pitch Enhancement and Autocorrelation

SMV uses pitch enhancement for the fixed codebook FCB in order to increase the speech quality. Some SMV-based terms are described next. A "main pulse" is a pulse at a position selected from a list in a pulse codebook. "Pitch enhancement" refers to insertion of one or more additional pulses before or after the main pulse in a subframe in a manner repeating the main pulse and spaced from the main pulse or nearest one of the additional pulses by an interval equal to an integer number called the "pitch lag" of the subframe. The integer (INT) Pitch (P) lag (lower case ell "l") is symbolized $l^P_{INT}$. "Forward pitch enhancement" inserts the one or more additional pulses after the main pulse. "Backward pitch enhancement" inserts the one or more additional pulses before the main pulse.

CELP (Code Excited Linear Prediction) based codecs can use some form of pitch enhancement for the fixed codebook excitation. In some CELP codecs, forward pitch enhancement is used and not backward pitch enhancement. SMV uses both forward pitch enhancement and backward pitch enhancement to increase the speech quality. The computational complexity increases significantly with increased backward pitch enhancements. The improved methods herein cut down this higher computational complexity by approaches which do not need to adversely affect the perceptual speech quality.

The Selectable Mode Vocoder (SMV) uses a subframe strategy to encode the pitch and secondary excitation. SMV uses variable subframe length (also called subframe size), based on the speech classification Type. Subframe length is symbolized $L_{SF}$ (which is not to be confused with the symbol LSF for line spectral frequency).

A particular embodiment described herein is associated with the encoder when the analysis subframe size $L_{SF}$ is 53 or 54 samples. The SMV speech codec chooses sub-frame sizes 53 or 54 for Rate ½ Type 1 (voiced stationary) speech frames. The choice of this sub-frame size increases the computational complexity of the search algorithm.

When subframe length $L_{SF}$ is 53/54 and the pitch lag $l^P_{INT}$ is small (17 or 18), SMV inserts up to a maximum of three backward enhanced pulses with exponentially decaying amplitudes. It is noted herein that under these circumstances the contribution of the last enhancement pulse is very minimal. Hence, this pulse contribution can be advantageously and effectively removed for sub-frame size 53/54 with low pitch lag values.

An improvement Aspect 1 herein called Conditional Elimination Backward Pitch Enhancement, for which an example is just given, reduces the computational complexity in calculation of energy correlations (compare Phi Matrix Φ for generating the denominator $\|y^2\|$ for Cost function epsilon tilde) for impulse response used in fixed codebook search. The improvement is different and advantageous, among other reasons, because conditional elimination of backward pitch enhancement for certain specific cases of speech simplifies backward pitch enhancement processing substantially.

The Conditional Elimination Backward Pitch Enhancement method described herein remarkably achieves fully comparable voice quality by an advantageously approximate approach for backward pulse enhancement using only up to two pitch enhancement pulses. Efficient pre-computation with overlaid memory usage hence effectively and further reduces computer burden without any memory penalty.

The complexity of the search procedure in standard half rate SMV for Type 1 frames is very high, because it involves complex conditional logic in the search procedure. An improved method embodiment described herein uses pre-computed correlations of the impulse response and an improvement called Incremental Generation. This Pre-computed Correlations and Incremental Generation, or Aspect 2, improvement is used in various pitch enhancement embodiments independently of whether Aspect 1 or Conditional Elimination Backward Pitch enhancement is used or not.

This Pre-computed Correlations and Incremental Generation improvement advantageously reduces the number of Multiply Accumulates (MACs) up to 25% in the computation of impulse response energy correlations Phi Matrix. The usage of Pre-computed Correlations and Incremental Generation contributes up to 10%, in the computation of impulse response energy correlations Phi Matrix Φ, (3 MIPS in one application and currently-typical clock frequency) for additional process simplification and computational savings.

Among its other advantages, the improved method reduces the computational complexity of impulse response energy correlations by around 25% without affecting the quality compared to the standard SMv. The improvements provide greater channel density at the same voice quality as SMV, and moreover provide at least as much channel density as another standard called EVRC but at higher voice quality.

Summarizing some of the improved method aspects herein:

Limit the backward pitch enhancement to a maximum of only two exponentially decaying amplitudes when the subframe length is 53/54 or otherwise more than three times the pitch lag.

Pre-compute the impulse response correlations Phi Matrix to eliminate redundant computation.

Reduce the number of Multiply Accumulates up to 25% by Incremental Generation of impulse response correlations by dividing Phi Matrix into special regions where double nested loop processing is applicable and then executing the double nested loop processing.

Obviate and eliminate significant amounts of control code by the improved process of supplying values of Phi Matrix in regions by Incremental Generation.

Figure 7:
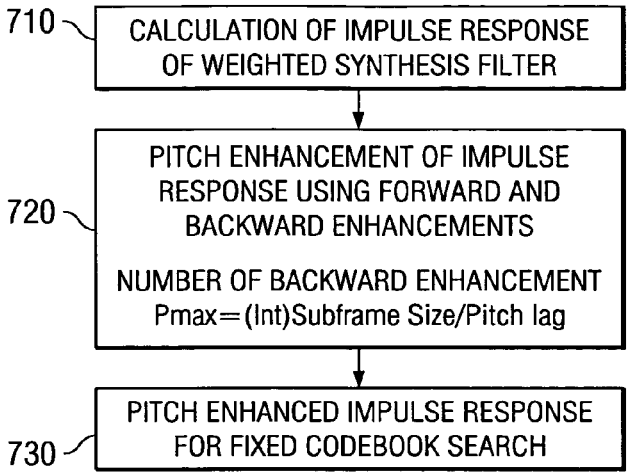
FIG. 7 is a flow diagram of an SMV method for SMV pitch enhancement.

FIG. 7 depicts a flow of conventional SMV pitch enhancement. Conventional SMV Pitch Enhancement is described at the 3GPP2 C.20030-0 Version 2.0 "Selectable Mode Vocoder Service Option for Wideband Spread Spectrum Communication Systems" document in sections 5.6.11.4 and 5.6.11.5 which sections are incorporated herein by reference.

In FIG. 7, at step 710, calculation of the impulse response of the weighted synthesis filter of the fixed codebook loop 410 (FIG. 4) occurs.

Next, in a step 720 pitch enhancement of the filter impulse response is performed using forward and backward pitch enhancements. The number of backward enhancements is an integer given by Pmax=(Int) Subframe Size/Pitch Lag.

Then in a step 730, there results the pitch-enhanced filter impulse response for use in fixed codebook search.

Figure 8:
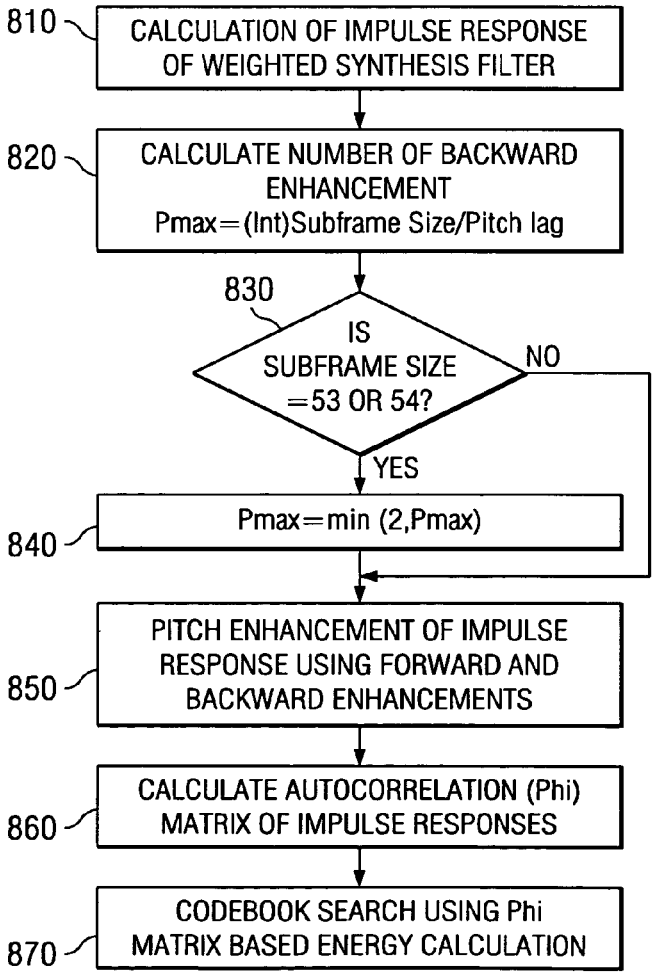
FIG. 8 is a flow diagram of an inventive method for Pitch Enhancement for inventive improvements to codebook searching as taught herein resulting in an inventive vocoder for the systems, devices and processes of FIGS. 1-5.

FIG. 8 depicts the flow of an improved method embodiment here. Operations in a step 810 calculate the impulse response of the weighted synthesis filter of the fixed codebook loop 410 (FIG. 4.)

Next, pitch enhancement of the filter impulse response is performed in a step 820 using forward and backward pitch enhancements, providing a number of backward enhancements that is an integer given as greatest integer less than or equal (integer function "INT( )") to the ratio of Subframe Size divided by integer Pitch lag delivered to block 360 of FIG. 3 among the control parameters CTRL.

$$P\max=\mathrm{INT}(L_{SF}/l^{P}_{INT}) \tag{6}$$

Then in FIG. 8, a decision step 830 determines whether the subframe size $L_{SF}$ has been selected to be 53 or 54 (i.e., a 160 sample subframe is divided in thirds of 53, 53, and 54 samples).

If yes, then operations branch to a step 840 and there limit the number of backward pitch enhancements to the lesser of two (2) or Pmax from Equation (6). This is what is meant in FIG. 8 by the notation Pmax=min(2, Pmax). ("min" stands for the minimum.) In this way, the case of three pitch enhancements otherwise permitted by standard SMV is prevented from occurring when the pitch lag is a third or less of the subframe size.

In general, various embodiments of this Conditional Elimination Backward Pitch Enhancement method establish a maximum number (e.g., 2) backward pitch enhancements Q when the ratio of subframe size to integer pitch lag is equal to or greater than (Q+1), i.e., the ratio equals at least one more than the maximum number of backward pitch enhancements.

After step 840 when subframe size is 53/54, (or also after step 830 when subframe size is not 53/54), operations proceed to a step 850.

Step 850 performs pitch enhancement using the forward and backward enhancements. In this improved way, there results the pitch-enhanced filter impulse response $H_p^{Pm}$ of hereinbelow Equation (7A) for use in fixed codebook FCB search.

Moreover, the Conditional Elimination Pitch Enhancement improvements are advantageously combined with the improvements to codebook searching disclosed in co-filed application 11/231,643 to yield still further improved methods, devices and systems for pitch enhancement and codebook search for voice codecs. Another embodiment combines embodiments in 11/231,643 for Rate 1 with an embodiment herein for Rate ½ stationary voiced (Type 1) frames. Thus, the inventive embodiments are applied in two different Rate paths of a combined process. Advantageously, this provides a complexity reduction. In other words, the 11/231,643 Selective Joint Search improvements to codebook searching, and the Conditional Elimination Pitch Enhancement improvements are allocated to different paths and this allocated structure provides improvements that are balanced and allocated over plural rates in a voice codec. Advantageously, the Pre-Computed correlations and Incremental Generation improvement is applied over both the Full Rate 1 and Half Rate (½) modes.

Complexity of codebook searches in general is reduced. Having a conditionally-limited number of backward pitch enhancements results in fewer non-causal impulse response vectors used in the computation of the impulse response correlations matrix (autocorrelation Phi Matrix). The complexity of computing impulse response correlation increases exponentially with number of backward pitch enhancements.

Hence, conditionally limiting the number of backward pitch enhancements has the effect of reducing complexity substantially.

As note hereinabove for one embodiment for SMV, the codebook search improvements of 11/231,643 and the conditional elimination pitch enhancement improvements herein are used in different paths. In SMV the subframe length $L_{SF}$ for Rate 1 frames is 40 samples and for Rate ½ stationary voiced (Type 1) frames the subframe length is either 53 or 54. In Rate 1 since the subframe length is 40 it does not have more than two (2) backward pitch enhancements (i.e., integer of (40/17)=2). On the Rate ½ side the maximum number of backward pitch enhancements is three (3) (i.e, integer part of 54/17).

Note that from a process standpoint, Rate 1 and Rate ½ codebook search processes involve different codebooks, different subframe lengths and different numbers of backward pitch enhancements. Hence, these operations are referred to as performed in different process paths.

The embodiment noted limits the maximum number of backward pitch enhancements to two (2) for Rate ½ Type 1 SMV frames. SMV otherwise would operate to constrain the decoder to replicate the $3^{rd}$ backward pulse enhancement if particular pulse positions are selected for Rate ½ Type 1 frame with Pitch Lag equaling 17/18. Accordingly, the embodiment may limit the backward pitch enhancements to two in the speech decoder as well. Since the significance of the third backward pitch enhancement is limited, it will operate with third backward pitch enhancement without problems at the decoder without any modifications.

In general, other embodiments of Conditional Elimination Pitch Enhancement in a generalized framework are unlimited in the particular paths used and the number of pitch enhancements and suitably provide an appropriate conditionally-limited number of backward pitch enhancements (and also forward pitch enhancements) for each pulse based on some constraints which can be understood at the decoder side. The word "understood" is used in the sense that the decoder can be successfully and correspondingly implemented to decode the coded voice produced by the voice coder that is using such constraints or assumptions. In Conditional Elimination Pitch Enhancement, the conditional limitation number may vary with different pulses in different codebooks and in different voice codecs. Advantageously, the improvements confer a reduction in computational complexity of codebook searches in general.

The constraints which can be understood at the decoder side are as follows. For example, suppose the speech encoder were designed in such a way where the conditionally-limited maximum number of backward pitch enhancements was one. This would imply that for every one main pulse there could be only one backward pitch enhancement pulse. Then at the decoder there would be at most one backward pitch enhancement vector provided for reconstruction of the fixed codebook vector (i.e., secondary excitation) for every main pulse position index that is received. Operating according to identical assumptions at the encoder and decoder ensures that the speech/voice codec operates without mismatch in the number of backward pitch enhancements.

Note two important aspects among others herein: 1) Conditional Elimination Backward Pitch Enhancement, and 2) Pre-computed Correlations and Incremental Generation of Phi Matrix. The focus of Steps 830, 840 and 850 in FIG. 8 is Aspect 1) Conditional Elimination Pitch Enhancement. The focus of Steps 860 and 870 in FIG. 8 (and FIGS. 9-11) is Aspect 2) Pre-computed Correlations and Incremental Generation of Phi Matrix. In various embodiments, steps 830, 840 are included. For Half Rate stationary voiced frames, the steps 830, 840, 850 can be provided for computation of $\|y^2\|$ in an alternative embodiment without the Incremental Generation improvement.

A conventionally generated autocorrelation Phi Matrix is described at the 3GPP2 C.S0030-0 Version 2.0 "Selectable Mode Vocoder Service Option for Wideband Spread Spectrum Communication Systems" sections 5.6.11.5, 5.6.11.6.2, and 5.6.11.7.4 hereby incorporated herein by reference.

In FIG. 8, a succeeding step 860 performs autocorrelation of the impulse responses and generates a symmetric autocorrelation (Phi) Matrix of the autocorrelated impulse responses. An autocorrelation is a set of correlations, each one being a correlation of the impulse response with the impulse response itself lagged by a respective different integer amount of lag. (Do not confuse this lag for autocorrelation purposes with the separate concept of pitch lag $l^P_{INT}$ of pitch enhancement pulses in FIG. 6.)

Subsequent step 870 then performs codebook search using the Phi Matrix based process of obtaining denominator $\|y^2\|$ and then establishing the Cost Function to generate a best approximation to the target signal $T_g$. Notice that the Phi Matrix does not have to be burdensomely generated during step 870. Phi Matrix has advantageously been generated beforehand in step 860 so that step 870 thus advantageously and rapidly accesses values from Phi Matrix while step 870 searches the codebook and calculates Cost function values that facilitate the codebook searching.

FIGS. 9, 10A, 10B, and 10C show examples of the autocorrelation Phi Matrix depending on different values of control parameters CTRL, and specifically the subframe size $L_{SF}$ and integer pitch lag $l^P_{INT}$.

Figure 9:
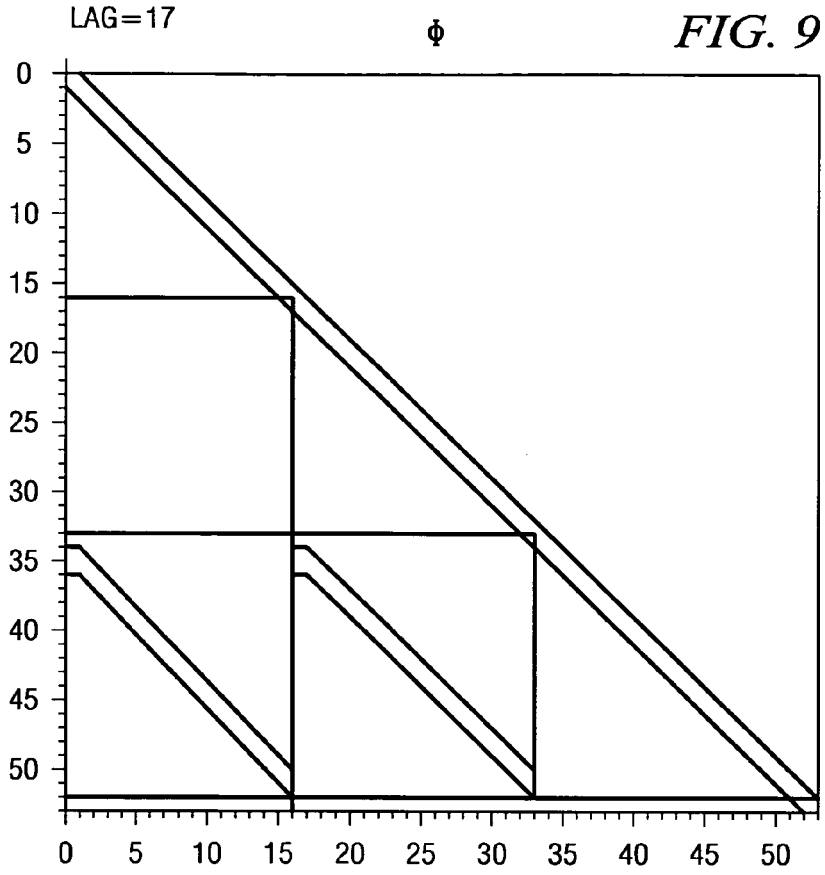
FIG. 9 is a data structure diagram of an autocorrelation matrix of impulse responses, or Phi Matrix, 53×53 for Pitch Lag equal to 17, for use in the inventive method for Pitch Enhancement of FIG. 8.

FIG. 9 depicts areas of the autocorrelation Phi Matrix in the case of subframe size 53/54 which is used for Half Rate Type 1 frames. Pitch Lag equals 17 in this example. Note that Phi Matrix has 54 rows (0-53) and 54 columns (0-53) corresponding to the larger number $L_{SF}$ of samples in the subframe. The Phi Matrix encompasses the one-smaller case of 53×53 autocorrelation matrix for subframe size 53.

Note further in FIG. 9 that the autocorrelation entries in Phi Matrix are grouped into triangular regions, a square rectangular region, and two ribbon-shaped parallelogram strip regions. The Phi Matrix $\Phi(i,j)$ is symmetric (meaning that $\Phi(j,i)=\Phi(i,j)$) so that depiction of symmetric regions and redundant cell values in the upper triangular region above the main diagonal of the Phi Matrix are omitted for brevity. These redundant cell values are suitably omitted to conserve memory space in some embodiments.

The main diagonal entries from cell (0,0) through cell (53, 53) are unlagged autocorrelation entries. For conciseness the boundaries between the various regions are indicated by pairs of column numbers and pairs of row numbers between each of which pairs the boundary lies. The boundary pairs for FIG. 9 are column number pairs (0,1), (16,17), (33,34), and (52,53); and row number pairs (0,1), (16,17), (33,34), (34,35), (35,36), (51,52), and (52,53). The strips are first, the set of cells at row-column locations {(35,0), (36,0-1), (37,1-2), (38, 2-3), . . . (51,15-16), (52,16)}, and second, the set of cells at row-column locations {(35,17), (36,17-18), (37,18-19), (38, 19-20), . . . (51,32-33), (52,33)}.

The vertices of the FIG. 9 ten pertinent regions for FIG. 11 double nested loop operation purposes, are as follows:

Triangle (0,0), (16,0), (16,16).

Square (17,0), (17,16), (33,0), (33,16).

Triangle (17,17), (33,17), (33,33)

Triangle (37,0), (52,0), (52,15)

Parallelogram strip (35,0), (36,0), (51,16), (52,16)

Triangle (34,0), (34,16), (50,16).
Triangle (37,17), (52,17), (52,32).
Parallelogram strip (35,17), (36,17), (51,33), (52,33)
Triangle (34,17), (34,33), (50,33)
Triangle (34,34), (52,34), (52,52)

Figure 10A:
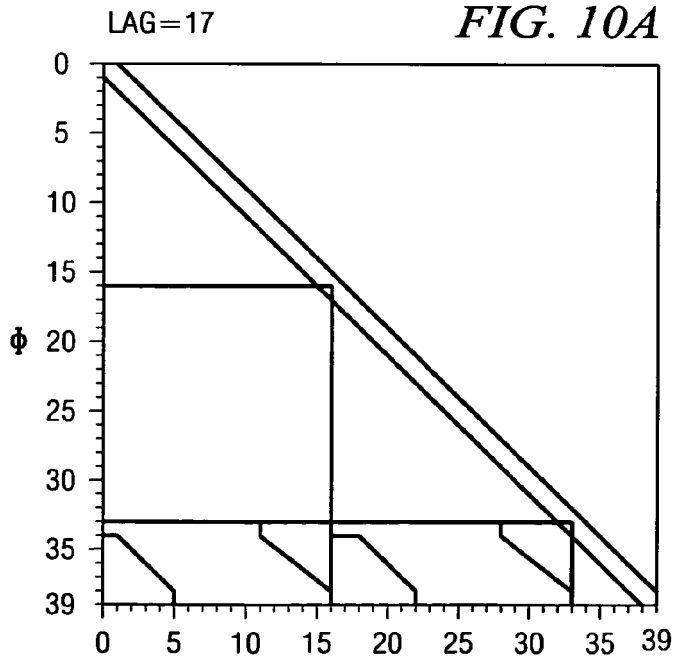
FIG. 10A is a data structure diagram of another autocorrelation matrix of impulse responses, or Phi Matrix, 39×39 for Pitch Lag equal to 17, for use in the inventive method for Pitch Enhancement of FIG. 8.
Figure 10B:
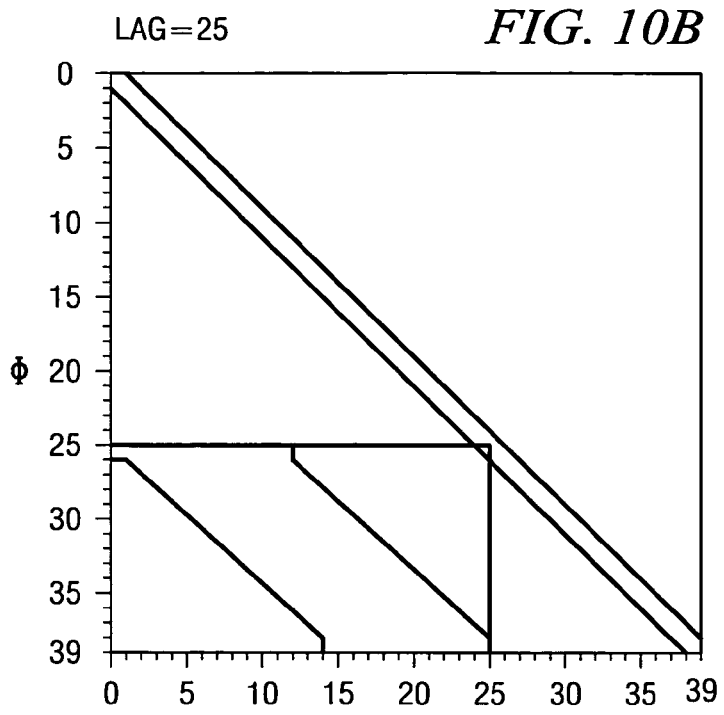
FIG. 10B is a data structure diagram of another autocorrelation matrix of impulse responses, or Phi Matrix, 39×39 for Pitch Lag equal to 25, for use in the inventive method for Pitch Enhancement of FIG. 8.
Figure 10C:
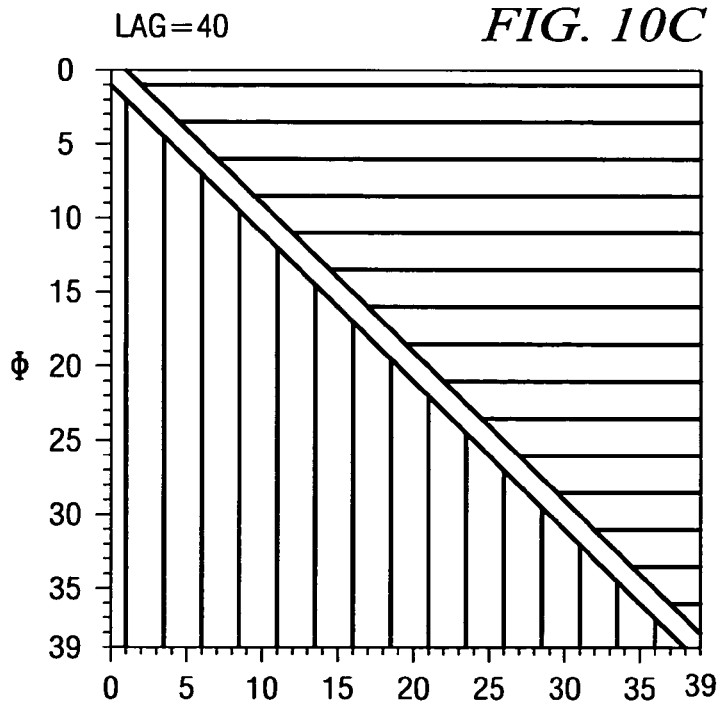
FIG. 10C is a data structure diagram of another autocorrelation matrix of impulse responses, or Phi Matrix, 39×39 for Pitch Lag greater than or equal to 40, for use in the inventive method for Pitch Enhancement of FIG. 8.

FIGS. 10A, 10B, and 10C respectively depict areas of the autocorrelation Phi Matrix in the Full Rate cases of subframe size 40 and Pitch Lag=17, Pitch Lag=25, and Pitch Lag greater than or equal to 40. Note that Phi Matrix has 40 rows (0-39) and 40 columns (0-39) corresponding to the number of samples in the subframe. For conciseness the boundaries between the various regions are again indicated by pairs of column numbers and pairs of row numbers between each of which pairs the boundary lies. The boundary pairs for FIG. 10A are column numbers (0,1), (4,5), (11,12), (16,17), (21, 22), (27,28), (33,34), and (38,39); and row numbers (0,1), (16,17), (33,34), and (38,39).

For FIG. 11 double nested loop operation purposes, vertex cell coordinates at index range limits (inclusive) are called vertices herein. Vertices of the FIG. 10A ten pertinent regions are as follows:

Triangle (0,0), (16,0), (16,16).
Square (17,0), (17,16), (33,0), (33,16).
Triangle (17,17), (33,17), (33,33)
Triangle (35,0), (39,0), (39,5)
Parallelogram (34,0), (34,11), (39,6), (39,16)
Triangle (34,12), (34,16), (38,16).
Triangle (35,17), (39,17), (39,21).
Parallelogram (34,17), (34,28), (39,22), (39,33)
Triangle (34,29), (34,33), (38,33)
Triangle (34,34), (39,34), (39,39)

Note further in FIG. 10A (Rate 1, Pitch Lag=17) that the autocorrelation entries in Phi Matrix are grouped into triangular regions, a square rectangular region, and two parallelogram regions. Again, the symmetrically located corresponding regions in the upper triangular region above the main diagonal are omitted for clarity. The main diagonal entries from cell (0,0) through cell (39, 39) are unlagged autocorrelation entries. For conciseness the boundaries between the various regions are again indicated by pairs of column numbers and pairs of row numbers between each of which pairs the boundary lies.

The boundary pairs for FIG. 10B are column numbers (0,1), (10,11), (13,14), (24,25) and (38,39); and row numbers (0,1), (24,25), (25,26), and (38,39). For FIG. 11 double nested loop operation purposes, the vertices of the five pertinent regions are as follows:

Triangle (0,0), (24,0), (24,24).
Triangle (26,0), (39,0), (39,13).
Parallelogram (25,0), (25,10), (39,14), (39,24)
Triangle (25,11), (25,24), (38,24)
Triangle (25,25), (39,25), (39,39)

Note further in FIG. 10B (Rate 1, Pitch Lag=25) that the autocorrelation entries in Phi Matrix are grouped into four triangular regions, and one parallelogram region. The symmetrically located corresponding regions in the upper triangular region above the main diagonal are omitted for clarity. The main diagonal entries from cell (0,0) through cell (39, 39) are unlagged autocorrelation entries. For FIG. 11 double nested loop operation purposes, the vertices of the five pertinent regions are as follows:

Triangle (0,0), (24,0), (24,24).
Triangle (26,0), (39,0), (39,13).
Parallelogram (25,0), (25,10), (39,14), (39,24)
Triangle (25,11), (25,24), (38,24)
Triangle (25,25), (39,25), (39,39)

In FIG. 10C, (Rate 1, Pitch Lag>=40) the autocorrelation entries in Phi Matrix are grouped into one triangular lower region and the symmetrically placed corresponding upper triangular region. Again, the main diagonal entries from cell (0,0) through cell (39, 39) are unlagged autocorrelation entries. For FIG. 11 double nested loop operation purposes, the vertices of the triangular lower region are (0,0), (39,39), (39,0).

PHI Matrix Computation

The purpose of Phi Matrix (ϕ) computation is to capture the correlation of impulse responses for various Pitch Lag values which are used in the fixed codebook search procedure.

In SMV, not only forward pitch enhancements but also backward pitch enhancements are used. The introduction of backward pitch enhancements results in non-causal contributions, that leads to multiple impulse response vectors depending in number on the pitch lag, the subframe size, and position of the main pulse.

Autocorrelation is a sum of multiplicative products of indexed values of the same time series multiplied times each other, and with the time series varied in lag with respect to itself over the range of index values that encompass the time series. This leads to autocorrelation computation of Phi Matrix elements at Section 5.6.11.5 of the incorporated SMV Spec. The Phi Matrix is written in somewhat different symbols as follows.

$$\Phi(i,\ j) = \sum_{k=\mathrm{MAX0}}^{LSF-1} H_p^{Pm(i)}(k-i)H_p^{Pm(j)}(k-j) \tag{7A}$$

The autocorrelation process multiplies vectors from filter matrix H by other vectors based on H and sums them up. In the Phi Matrix Equation (1), the resulting autocorrelation Phi Matrix Φ(i,j) has index i and index j that each independently range from zero (0) to $L_{SF}-1$ (subframe length $L_{SF}$ minus one). The range of summation that produces each cell value of the Phi Matrix is indexed on an index k which ranges between an upper value subframe size $L_{SF}$ minus one, and a lower value determined as the larger of two values according to:

$$k=\mathrm{MAX}\ ((i-P_m(i)\cdot l^P{}_{INT}),(j-P_m(j)\cdot l^P{}_{INT})) \tag{7B}$$

Integer pitch lag $l^P{}_{INT}$ is multiplied by a small counting number given by a function $P_m$ applied to index i and index j respectively. Function $P_m$ specifies the number (0, 1, 2 or 3) of backward pitch enhancement pulses that can exist if the main pulse were at the index value (of i or j) given a value of the integer pitch lag. Each result is respectively subtracted from index i or index j. The greater of the two numbers establishes the lower end of the range of summation over summation index k.

Further consider the product summand $H_p^{Pm(i)}(k-i)$ $H_p^{Pm(j)}(k-j)$ in Equation (7A). Each of the symbols $H_p^{Pm(i)}(k-i)$ and $H_p^{Pm(j)}(k-j)$ is called an "impulse response vector" herein because the singleton one in a pulse vector $p_i$ in effect selects a column or vector of values out of the filter matrix H of FIG. 6 when matrix H is matrix-multiplied by such pulse vector $p_i$. The impulse response vectors arise from the main pulse and the associated forward and backward pitch enhancement pulses.

Each impulse response vector represents the impulse response of the combination of a synthesis filter (e.g. filter 440 of FIG. 4) and weighting filter (e.g., 450). The impulse response appears, e.g., at the output of the weighting filter 450 when the input of the synthesis filter 440 is excited with an impulse corresponding to a main pulse p, of FIG. 6 at a pulse position selected from a codebook accompanied by a number of its backward pitch enhancement pulses given by the function $P_m$. Accordingly, in the description hereinbelow, $H_p^0$ represents an impulse response with no (zero) accompanying backward pitch enhancement pulses. $H_p^1$ represents an impulse response including one accompanying backward pitch enhancement pulse, and two for $H_p^2$ and so forth up to a maximum number of backward pitch enhancement pulses Pmax.

Qualitatively described, the relative values of index i and index j establish the relative positioning or autocorrelation lag between the two impulse response vectors that are variably positioned or variably lagged side-by-side relative to each other for purposes of generating the autocorrelation. Then the corresponding side-by-side numbers are multiplied to generate the products $H_p^{Pm(i)}(k-i)\ H_p^{Pm(j)}(k-j)$ for each value of summation index k, and then all added up by summing over the summation index k to obtain the autocorrelation Phi value for the index pair or combination (i,j).

In the above approach the computation of summation index "k" itself in Equation (7B) for the above Equation (7A) for correlation element computation is quite intensive as it is repeated for each (i,j) index combination. Also, the processor identifies each impulse response vector $H_p^{Pm(i)}(k-i)$ and $H_p^{Pm(j)}(k-j)$ that is chosen for each index (i,j) combination. (Each impulse response vector is simply called a "vector" hereinbelow.) This results in significant burden for the computation complexity. Some processors when architecturally optimized for fast multiply-accumulates (MACs) in digital signal processing may be less efficient and consume a lot of computation power handling control code for controlling these indexes and choosing and retrieving from memory the appropriate vector for correlation computation.

However the index controlling computation can be greatly simplified or eliminated by isolating and identifying the range of index values (i,j) for which the choice of impulse vectors remains the same. The computational requirement for index "k" also is much-reduced or eliminated for those regions since the value for the maximum MAX function of Equation (7B) is the same for every pair of index values (i,j) in any one such region.

Consider the following example related to FIG. 10B in the Triangle of cells with vertices (0,0), (24,0),(24,24).

Let $L_{SF}$=40, and let integer pitch lag $l^P_{INT}$=25. For the given example $$P_m(i)=0, \text{ for } 0<=i<25 \text{ and} \tag{8}$$

$$P_m(i)=1, \text{ for } 25<=i<40. \tag{9}$$

For the given example there are two impulse response vectors $H^0_p(i)$ and $H^1_p(i)$.

Now using Equation (7A)

$$\Phi(24, 24) = H_p^0(15) * H_p^0(14) * H_p^0(14) + \ldots + H_p^0(0) * H_p^0(0) \tag{10}$$

$$\Phi(23, 23) = H_p^0(16) * H_p^0(16) + H_p^0(15) * H_p^0(15) + H_p^0(14) * H_p^0(14) + \ldots + H_p^0(0) * H_p^0(0) \tag{11}$$

Considering Equation (10) and Equation (11) together reveals that once a first value of autocorrelation Phi Matrix Φ(i,j) such as Φ(24,24) of Equation (10) is computed at the upper end of an index range for a region, the subsequent values of Phi Matrix Φ(i,j) in the region are the same as $$\Phi(23, 23) = \Phi(24, 24) + H_p^0(16) * H_p^0(16) \tag{11A}$$

$$\Phi(22, 22) = \Phi(23, 23) + H_p^0(17) * H_p^0(17) \tag{12A}$$

$$\vdots$$

$$\Phi(0, 0) = \Phi(1, 1) + H_p^0(39) * H_p^0(39) \tag{13A}$$

Equations (11A), (12A), . . . (13A) are examples of what is called herein "Incremental Generation." In other words, instead of having to perform an extremely tedious repetition of extremely numerous multiplying and adding, as in Equation (11), a much-reduced single multiply-add operation of Equation (11A) is provided.

Similarly, $$\Phi(24, 23) = H_p^0(15) * H_p^0(16) + H_p^0(14) * H_p^0(15) + \ldots H_p^0(0) * H_p^0(1) \tag{14A}$$

$$\Phi(23, 22) = \Phi(24, 23) + H_p^0(16) * H_p^0(17) \tag{14B}$$

$$\Phi(22, 21) = \Phi(23, 23) + H_p^0(17) * H_p^0(18) \tag{14C}$$

$$\vdots$$

$$\Phi(1, 0) = \Phi(2, 1) + H_p^0(38) * H_p^0(39) \tag{14D}$$

Advantageously, comprehensive consideration of various index values now reveals a process wherein i=0, 1, . . . 24 & j=0, 1, . . . 24 the process uses vector $H^0_p$ for autocorrelation generation.

Similarly, for i=25, 26, . . . 39 & j=25, 26, . . . 39 the process uses vectors $H^1_p$ for autocorrelation.

For i=0, 1, . . . 24 & j=25, 26, . . . 39 the process uses vectors $H^0_p(i)$ and $H^1_p(j)$ i. for autocorrelation.

From the above observations, note particular regions of Phi Matrix are identifiable in which the impulse response vector products $H_p^{Pm(i)}(k-i)\ H_p^{Pm(j)}(k-j)$ have both superscripts unchanging in any given one such region. These regions can be identified, separated out or segregated for purposes of the remarkable processing operational method based on the region of index (i,j) combinations. For each such region or range of index (i,j) combinations, the computation and indexing is simplified and written in a simplified fashion. Then the process of operating the processor is performed and executed in a double nested loop structure applied to rapidly generate all the Phi matrix values in one of the regions. Then the double nested loop structure is applied to rapidly generate all the Phi Matrix values in another one of the regions, and so on until all the values for the entire Phi Matrix are rapidly obtained in this remarkable process.

Each Phi Matrix of FIGS. 9, 10A, 10B, 10C is shown and generated respectively to a given corresponding value of the Pitch Lag $l^P_{INT}$. Each such Phi Matrix has outlined regions drawn therein. Each outlined region represents the set or combination of indexes (i,j) for which the Phi Matrix Φ(i,j) can be efficiently computed with a single one of the double nested loop structures of FIG. 11. For each of these regions the lower limit of index k=MAX( ) in the auto-correlation Phi Matrix Φ(i,j) Equation (6) is very simple to determine or can be pre-computed. Thus, explicit computation is unnecessary and index k is advantageously established instead by incrementing or decrementing of registers in DSP instructions.

In FIG. 11, an improved process of operating the processor is performed and executed in a double nested loop structure.

The flow chart of FIG. 11 represents an embodiment of operational process used to generate the triangular shaped region of indices (i,j) of the autocorrelation Phi Matrix Φ(i,j) in FIG. 10B defined hereinabove as Triangle (0,0), (24,0), (24,24). For example, in FIG. 10B and FIG. 11, the process generates Φ(24,24) . . . Φ(0,0) for $L_{SF}$=40 and integer pitch lag $l^{P}_{INT}$=25 in an inner loop. Then the process generates Φ(24,23) . . . Φ(1,0); Φ(24,22) . . . Φ(2,0); . . . down to Φ(24,1) . . . Φ(23,0) followed by value Φ(24,0).

In FIG. 11, a Phi Matrix generation process 1100 commences with BEGIN 1105 and proceeds to a step 1110 to identify regions of equal numbers of backward pitch enhancements such that Pm(i) and Pm(j) are each unvarying in the region. In this Triangle example, the backward pitch enhancement numbers are zero.

Then a step 1120 temporarily stores values $i_{max}$, $i_{min}$, $i_{max}$, $j_{min}$ defining the index range(s) that identify the region. In the Triangle, $i_{max}$=24, $i_{min}$=0, $j_{max}$=24, $j_{min}$=0.

A succeeding step 1130 next initializes decrementable loop indices i' and j' at the respective upper ends $i_{max}$, $j_{max}$ of the ranges defining the region.

A decision step 1140 determines whether outer loop index $j_{max}$ is still greater than or equal to the lower limit $j_{min}$ of its index range.

If so (Yes), then operations proceed to an operational process step 1150 that generates a cell value of the auto-correlation Phi Matrix Φ(i,j) where i=i' and j=j' according to summation Equation (7A) and stores that cell value of Phi Matrix Φ(i,j). For the Triangle example that value is Φ(24,24) from Equation (10) hereinabove.

Succeeding step 1160 uses Incremental Generation to incrementally compute and supply a cell value of the autocorrelation Phi Matrix Φ(i,j) where (i,j)=(i',j') and (i',j') is repeatedly decremented on both indices (i'−1, j'−1) by step 1170, and stores each resulting cell value of Phi Matrix Φ(i,j). Then a decision step 1175 checks whether index i-prime is less than its minimum value $i'<i_{min}$. If not, operations loop back to step 1160 generate another cell value of Phi Matrix Φ(i,j) by the remarkably efficient Incremental Generation method herein.

Steps 1160, 1170, 1175, 1160 thus constitute an inner loop back to step 1160 in the double loop structure of FIG. 11. In the inner loop step 1160, the set of indices (i,j) computed are given by the set $\{(i'-1, j'-1), (i'-2, j'-2), \ldots (i_{min}, j'-i'+i_{min})\}$ whereupon each resulting cell value of Phi Matrix Φ(i,j) is determined by Incremental Generation and stored.

In process step 1160 Incremental Generation is performed by recalling brute-force Equation (7A)

$$\Phi(i, j) = \sum_{k=\mathrm{MAX0}}^{LSF-1} H_p^{Pm(i)}(k-i)H_p^{Pm(j)}(k-j) \tag{7A}$$

The next autocorrelation value (if any left) in the identified region is $$\Phi(i-1, j-1) = \sum_{k=\mathrm{MAX0}}^{LSF-1} H_p^{Pm(i-1)}(k-(i-1))H_p^{Pm(j-1)}(k-(j-1)) \tag{15}$$

Note that because the inner loop is following a trajectory from (i,j) to (i−1, j−1) in the same region, Pm(i−1) is still same as Pm(i), and Pm(j−1) is still same as Pm(j). Moreover, let the lower-end value of k for computing Phi Matrix cell (i,j) be designated $k_0$=MAX( ), same as from Equation (7B). But now, the lower end value of k for computing Phi Matrix cell (i−1, j−1) is, because of the identified region, just one less in Equation (15) than it was in Equation (7A).

Remaining in the identified region as taught herein allows Equation (15) to be rewritten $$\Phi(i-1, j-1) = \sum_{k=ko-1}^{LSF-1} H_p^{Pm(i)}(k-(i-1))H_p^{Pm(j)}(k-(j-1)) \tag{16}$$

Subtracting Φ(i,j) Equation (7A) from Equation (16) and rearranging, yields an Incremental Generation for process step 1160:

$$\Phi(i-1, j-1) = \Phi(i, j) + \sum_{k=ko-1}^{LSF-1} H_p^{Pm(i)}(k-(i-1))H_p^{Pm(j)}(k-(j-1)) - \sum_{k=ko}^{LSF-1} H_p^{Pm(i)}(k-i)H_p^{Pm(j)}(k-j) \tag{17}$$

Inspection of the two summations in Equation (17) shows that all terms except the top summand of the first summation are cancelled out by subtraction by the second summation. The H values with indices (k−(i−1)) and (k−(j−1)) in the first summation are cancelled because $$((k-1)-(i-1))=(k-i) \text{ and} \tag{18}$$

$$((k-1)-(j-1))=(k-j) \tag{19}$$

The result of subtraction in Equation (17) is a far-simplified Incremental Generation for process step 1160 as shown next:

$$\Phi(i-1,j-1)=\Phi(i,j)+H_p^{Pm(i)}(L_{SF}-i)H_p^{Pm(j)}(L_{SF}-j) \tag{20}$$

This Incremental Generation for autocorrelation Phi Matrix purposes is remarkable and advantageous for substantially reducing the burden on the processor. Simply by multiplying two H values and adding them to a previously-computed Phi Matrix cell value at indices (i,j) suffices with only one Multiply-Accumulate (1 MAC) to yield another cell value diagonally "northwest" of it, until the boundary of the identified region is reached.

In FIG. 11, the indices (i',j') are decremented equally with each loop of step 1160. Remember index i-prime i' starts out at value $i_{max}$ and index j-prime j' starts out at value $j_{max}$. Then when index i-prime i' reaches the lower end $i_{min}$ of its range in the region by operation of step 1170, the index j-prime reaches the corresponding value $$j_{min}=j'-(i'-i_{min})=j'-i'+i_{min}. \tag{21}$$

Accordingly, to define the loop ranges for the indices for the region, three index values such as $i_{max}$, $i_{min}$, $j_{max}$ are sufficient. The testing step 1175 simply tests one of the indices such as index i so that the inner loop of step 1160 ends when i-prime is decremented below the minimum value $i_{min}$. In the Triangle example, this initially occurs when i-prime i' is decremented below zero.

The decision step 1175 thus checks whether index i-prime is less than its minimum value $i'<i_{min}$. If so (Yes) at step 1175, operations proceed to a step 1180 to decrement the outer loop index $j_{max}=j_{max}-1$ in the case of a bottom-down triangle. In the cases of a bottom-up triangle or a parallelogram leave the outer loop index unchanged. This outer loop index represents a Phi Matrix column in which operations are to begin on the next inner loop cycle. The maximum row value $i_{max}$ is unchanged in this embodiment.

Next in a step 1190, the minimum row value $i_{min}$ or maximum row value $i_{max}$ is either left unchanged or altered in an advantageously uncomplicated manner that depends on the shape of the region. In general, the minimum and maximum row values are different functions of the maximum row and column values as follows:

$$i_{min}=f1(i_{max},j_{min},j_{max}) \quad (22)$$

$$i_{max}=f2(i_{min},j_{max},j_{max}) \quad (23)$$

In the case of a bottom-down triangle such as the Triangle here, leave the maximum row value $i_{max}$ unchanged and increment the minimum row value $i_{min}=i_{min}+1$. Also, in that case of bottom-down triangle, $$i_{min}=i_{max}-j_{max}. \quad (22A)$$

In the case of a bottom-up triangle or parallelogram canted left as in the illustrations, in step 1190 leave the minimum row value $i_{min}$ unchanged and increment the maximum row value $i_{max}=i_{max}+1$.

For purposes of step 1190, treat a square as two triangular regions, one triangle bottom-down, the other triangle bottom up. Also because the processing trajectory is diagonal, treat each rectangle as three regions, one triangle bottom-down, one parallelogram, and one triangle bottom-up. This accounts for the various shapes of regions in FIGS. 9, 10A and 10B.

Operations proceed from step 1190 back to step 1130 to reset the row index i-prime i' equal to $i_{max}$ and column index j-prime j' to $j_{max}$.

An outer loop comprised of steps 1130 through 1190 surrounds the inner loop of steps 1160-1175. At the conclusion of operations of the outer loop, decision step 1140 determines that outer loop index $j_{max}$ is no longer greater than or equal to the lower limit $j_{min}$ of its index range and branches to a RETURN 1180. In the Triangle case outer loop index $j_{max}$ has gone below zero, the lower limit $j_{min}$ of its index range, and branches to RETURN 1180.

Having thus described an operational process embodiment, attention is directed back to each of FIGS. 9, 10A, 10B, and 10C with regions as specifically defined in this detailed description. In every case, the regions are in the shape of a square, parallelogram, or triangle, so that the double nested loop structure of FIG. 11 is sufficient or more than sufficient to encompass the much-simplified operational process. In this way, Pitch Enhancement is advantageously accomplished with many fewer process operations and attendant power dissipation and real-time burden.

A few preferred embodiments have been described in detail hereinabove. It is to be understood that the scope of the invention comprehends embodiments different from those described yet within the inventive scope. Microprocessor and microcomputer are synonymous herein. Processing circuitry comprehends digital, analog and mixed signal (digital/analog) integrated circuits, ASIC circuits, PALs, PLAs, decoders, memories, non-software based processors, and other circuitry, and digital computers including microprocessors and microcomputers of any architecture, or combinations thereof. Internal and external couplings and connections can be ohmic, capacitive, direct or indirect via intervening circuits or otherwise as desirable. Implementation is contemplated in discrete components or fully integrated circuits in any materials family and combinations thereof. Various embodiments of the invention employ hardware, software or firmware. Block diagrams of hardware are suitably used to represent processes and process diagrams and vice-versa. Process diagrams herein are representative of flow diagrams for operations of any embodiments whether of hardware, software, or firmware, and processes of manufacture thereof.

While this invention has been described with reference to illustrative embodiments, this description is not to be construed in a limiting sense. Various modifications and combinations of the illustrative embodiments, as well as other embodiments of the invention may be made. The terms "including", "includes", "having", "has", "with", or variants thereof are used in the detailed description and the claims to denote non-exhaustive inclusion in a manner similar to the term "comprising". It is therefore contemplated that the appended claims and their equivalents cover any such embodiments, modifications, and embodiments as fall within the true scope of the invention.

What is claimed is:

1. An electronic circuit comprising a storage circuit; and a microprocessor operable together with the storage circuit as a speech coder, the speech coder having a backward pitch enhancement in frames or subframes having a length and at least one main pulse and at least one backward pitch enhancement pulse preceding the main pulse by a portion of the length called a pitch lag, and operable to limit in number any such backward pitch enhancement pulse or pulses to a predetermined maximum number more than none upon an occurrence when the length divided by the pitch lag is at least one more than that maximum number.

2. The electronic circuit of claim 1 wherein the main pulse has a pulse position in the frame or subframe and wherein the speech coder is operable to prevent the backward pitch enhancement pulses from exceeding in number the pulse position of the main pulse divided by the pitch lag.

3. The electronic circuit of claim 1 wherein the limit operation has a condition that subframe size is at least a predetermined minimum number.

4. The electronic circuit of claim 3 wherein the minimum number is 53.

5. The electronic circuit of claim 3 wherein the limit operation has a condition that the pitch lag is less than a predetermined pitch lag number.

6. The electronic circuit of claim 3 wherein the predetermined pitch lag is selected from the group including 17 and 18.

7. The electronic circuit of claim 1 wherein the limit operation has a condition that the pitch lag is less than a predetermined pitch lag number.

8. The electronic circuit of claim 7 wherein the predetermined pitch lag is selected from the group including 17 and 18.

9. The electronic circuit of claim 1 wherein the maximum number of backward pitch enhancement pulses is two.

10. The electronic circuit of claim 1 wherein the speech coder has rates including a higher rate and a lower rate, and wherein the speech coder is operable to limit backward pitch enhancement pulses to the maximum number at the lower rate.

11. The electronic circuit of claim 10 wherein the maximum number of backward pitch enhancement pulses is two.

12. The electronic circuit of claim 1 wherein the speech coder is operable to process of voiced stationary speech frames and voiced non-stationary speech frames at rates for the processing including a higher rate and a lower rate, and wherein the speech coder is operable to limit backward pitch enhancement pulses to the maximum number at the lower rate for voiced stationary speech frames.

13. The electronic circuit of claim 12 wherein the maximum number of backward pitch enhancement pulses is two and the subframe length is at least three times the lowest pitch lag for voiced stationary speech frames at the lower rate.

14. The electronic circuit of claim 12 wherein the maximum number of backward pitch enhancement pulses is two and the subframe length is at least three times the lowest pitch lag for voiced stationary speech frames.

15. The electronic circuit of claim 1 wherein the speech coder is operable to process voiced stationary speech frames and voiced nonstationary speech frames, and further operable to limit backward pitch enhancement pulses to the maximum number in at least one instance of voiced stationary speech frames.

16. The electronic circuit of claim 1 wherein the speech coder is further operable to supply at least one additional backward pitch enhancement pulse preceding the at least one backward pitch enhancement pulse, and each backward and additional backward pitch enhancement pulse has a respective amplitude, and each additional backward pitch enhancement pulse having a lower amplitude than any backward pitch enhancement pulse that such additional backward pitch enhancement pulse precedes.

17. The electronic circuit of claim 16 wherein the backward pitch enhancement pulses have exponentially decaying amplitudes the further they precede the main pulse.

18. The electronic circuit of claim 1 wherein the speech coder is operable to associate at least one forward pitch enhancement pulse with the main pulse.

19. The electronic circuit of claim 18 wherein the forward pitch enhancement pulse succeeds the main pulse by the pitch lag.

20. The electronic circuit of claim 18 wherein the speech coder is operable to provide the forward pitch enhancement pulse when the length less the position of the main pulse is at least as much as the pitch lag.

21. A wireless communications unit comprising a wireless antenna;

a wireless transmitter and receiver coupled to said wireless antenna;

a speech input circuit for converting first audible speech into a first electrical form;

a speech output circuit for converting a second electrical form into second audible speech;

a microprocessor coupled to the transmitter and receiver, and further coupled to the speech input circuit and to the speech output circuit, the microprocessor operable as a speech coder to process the speech from the first electrical form and in frames or subframes having a length by supplying at least one main pulse and at least sometime associating with the main pulse at least one backward pitch enhancement pulse preceding the main pulse by a portion of the length called a pitch lag, and to limit in number any such backward pitch enhancement pulse or pulses to a predetermined maximum number more than none upon an occurrence when the length divided by the pitch lag is at least one more than that maximum number, the wireless transmitter coupled to the speech coder; and the microprocessor further operable as a speech decoder to correspondingly process coded speech of a type coded as aforesaid received by the wireless receiver so as to decode the coded speech into the second electrical form and couple to the speech output circuit.

22. An electronic circuit comprising a storage circuit; and a microprocessor operable together with the storage circuit as a speech coder, the speech coder having a backward pitch enhancement in frames or subframes having a length and at least one main pulse and at least one backward pitch enhancement pulse preceding the main pulse by a portion of the length called a pitch lag, and operable for incremental generation of different values of autocorrelation of filter impulse response within a region of the autocorrelation where the number of backward pitch enhancement pulses is the same in the region, and to supply coded speech that depends on different values of autocorrelation incrementally generated.

23. The electronic circuit claimed in claim 22 wherein the incremental generation includes generation of a first value of autocorrelation in the region as a sum of products and then generation of at least one additional value of autocorrelation in the region by addition of the first value with a single product of values of filter impulse response with the first value.

24. The electronic circuit claimed in claim 22 wherein the autocorrelation is indexed by at least a first index and a second index respective to filter impulse responses to first and second pulses having independent first and second numbers of backward pitch enhancement pulses, where the first number of backward pitch enhancement pulses is the same over the region, and the second number of backward pitch enhancement pulses is the same over the region.

25. The electronic circuit claimed in claim 22 wherein the incremental generation includes generation of the different values for a region using a double nested loop.

26. The electronic circuit claimed in claim 25 wherein the incremental generation includes incrementation of starting points for the double nested loop to define a triangle.

27. The electronic circuit claimed in claim 25 wherein the incremental generation includes incrementation of starting points for the double nested loop to define a parallelogram.

28. The electronic circuit claimed in claim 25 wherein the incremental generation includes incrementation of starting points for the double nested loop to define a triangle, a parallelogram, and a triangle collectively forming a rectangle.

29. The electronic circuit claimed in claim 25 wherein the incremental generation includes incrementation of starting points for the double nested loop to define two triangles collectively forming a square.

30. The electronic circuit claimed in claim 22 wherein the supplying includes a codebook search for pulses, the search based on values of the autocorrelation resulting from the incremental generation.

31. The electronic circuit claimed in claim 30 wherein the speech coder is operable to repeat the incremental generation in a manner region-by-region of autocorrelation prior to the codebook search.

32. The electronic circuit claimed in claim 22 wherein the incremental generation includes repeated generation of values of autocorrelation in the region by addition of a single product to each previous value in a manner diagonally progressive across the region.

33. The electronic circuit claimed in claim 22 wherein the incremental generation includes repeated incremental generation region-by-region of autocorrelation for different shapes of regions.

34. The electronic circuit claimed in claim 22 wherein the shape of the region depends on the subframe length.

35. The electronic circuit claimed in claim 22 wherein the shape of the region depends on the pitch lag.

36. The electronic circuit claimed in claim 22 wherein the speech coder is operable to repeat the incremental generation in a manner region-by-region of autocorrelation wherein the regions in number depend on the subframe length.

37. The electronic circuit claimed in claim 22 wherein the speech coder is operable to repeat the incremental generation in a manner region-by-region of autocorrelation wherein the regions in number depend on the pitch lag.

38. A wireless communications unit comprising a wireless antenna;

a wireless transmitter and receiver coupled to said wireless antenna;

a speech input circuit for converting first audible speech into a first electrical form;

a speech output circuit for converting a second electrical form into second audible speech;

a microprocessor coupled to the transmitter and receiver, and further coupled to the speech input circuit and to the speech output circuit, the microprocessor operable as a speech coder to process by backward pitch enhancement the speech from the first electrical form and in frames or subframes having a length by supplying at least one main pulse and at least sometime associating with the main pulse at least one backward pitch enhancement pulse preceding the main pulse by a portion of the length called a pitch lag, and incrementally generate different values of autocorrelation of filter impulse response within a region of the autocorrelation where the number of backward pitch enhancement pulses is the same in the region, and supply coded speech that depends on different values of autocorrelation incrementally generated, the wireless transmitter coupled to the speech coder; and the microprocessor further operable as a speech decoder to correspondingly process coded speech of a type coded as aforesaid received by the wireless receiver so as to decode the coded speech into the second electrical form and couple to the speech output circuit.

39. Operating an electronic device to perform a process of backward pitch enhancement for a speech coding method of processing speech in frames or subframes having a length by supplying at least one main pulse and at least sometime associating with the main pulse at least one backward pitch enhancement pulse preceding the main pulse by a portion of the length called a pitch lag, and the process comprises limiting in number any such backward pitch enhancement pulse or pulses to a predetermined maximum number more than none upon an occurrence when the length divided by the pitch lag is at least one more than that maximum number; and transmitting signals comprising coded speech that is responsive to the backward pitch enhancement pulse.

40. Operating an electronic device to perform a process of backward pitch enhancement for a speech coding method of processing speech in frames or subframes having a length by supplying at least one main pulse and at least sometime associating with the main pulse at least one backward pitch enhancement pulse preceding the main pulse by a portion of the length called a pitch lag, and the process comprises incrementally generating different values of autocorrelation of filter impulse response within a region of the autocorrelation where the number of backward pitch enhancement pulses is the same in the region; and transmitting signals comprising coded speech that depends on different values of the incrementally generated different values of autocorrelation.

* * * * *